US007885590B2

(12) United States Patent
Seo et al.

(10) Patent No.: US 7,885,590 B2
(45) Date of Patent: Feb. 8, 2011

(54) IMAGE FORMING APPARATUS AND FIXING DEVICE

(75) Inventors: Hiroshi Seo, Sagamihara (JP); Akiko Ito, Machida (JP); Tadashi Ogawa, Machida (JP); Toshiaki Higaya, Kawasaki (JP)

(73) Assignee: Ricoh Company, Ltd., Tokyo (JP)

( * ) Notice: Subject to any disclaimer, the term of this patent is extended or adjusted under 35 U.S.C. 154(b) by 301 days.

(21) Appl. No.: 11/785,271

(22) Filed: Apr. 17, 2007

(65) Prior Publication Data

US 2007/0242988 A1 Oct. 18, 2007

(30) Foreign Application Priority Data

Apr. 17, 2006 (JP) ..... 2006-112952
Jan. 18, 2007 (JP) ..... 2007-009483

(51) Int. Cl.
*G03G 15/20* (2006.01)

(52) U.S. Cl. ..... 399/328

(58) Field of Classification Search ..... 399/328, 399/336

See application file for complete search history.

(56) References Cited

U.S. PATENT DOCUMENTS 5,552,582 A * 9/1996 Abe et al. ..... 219/619
5,768,673 A 6/1998 Morigami
5,832,354 A 11/1998 Kouno et al.
5,915,147 A 6/1999 Kouno et al.
6,021,303 A * 2/2000 Terada et al. ..... 399/328
6,169,871 B1 1/2001 Higaya
6,255,632 B1 7/2001 Yokoyama et al.
6,262,404 B1 7/2001 Higaya et al.
6,292,648 B1 9/2001 Higaya et al.
6,327,456 B1 12/2001 Higaya
6,340,810 B2 1/2002 Yokoyama et al.
6,753,515 B2 6/2004 Miyahara et al.

(Continued)

FOREIGN PATENT DOCUMENTS

EP 0 957 412 11/1999

(Continued)

OTHER PUBLICATIONS

Search Report for corresponding European patent application No. 07251575.2 dated Nov. 19, 2010.

*Primary Examiner*—David M Gray
*Assistant Examiner*—Barnabas T Fekete
(74) *Attorney, Agent, or Firm*—Harness, Dickey & Pierce, P.L.C.

(57) ABSTRACT

An image forming apparatus includes an image carrier to carry a toner image and a fixing device to fix the toner image transferred from the image carrier onto a recording medium by applying at least heat to at least one of the toner image and the recording medium. Such a fixing device includes: a magnetic flux generator to generate a magnetic flux; and a heat generating member disposed at least partially in the magnetic flux. The heat generating member includes a heat generating layer to generate heat via eddy currents therein induced by the magnetic flux, magnitudes of the eddy currents varying according to positions thereof in a width direction of the heat generating layer. Included within the heat generating layer is a magnetic layer having a Curie point in a range, e.g., from about 100 degrees centigrade to about 300 degrees centigrade.

20 Claims, 9 Drawing Sheets

U.S. PATENT DOCUMENTS

| | | | | |
|---|---|---|---|---|
| 6,899,986 | B2 | 5/2005 | Aoki et al. | |
| 6,946,629 | B2 | 9/2005 | Miyahara et al. | |
| 7,135,660 | B2 | 11/2006 | Miyahara et al. | |
| 7,194,234 | B2 * | 3/2007 | Katakabe et al. | 399/330 |
| 7,239,836 | B2 * | 7/2007 | Nanjo et al. | 399/328 |
| 7,349,662 | B2 * | 3/2008 | Nanjo | 399/328 |
| 7,388,595 | B2 * | 6/2008 | Yasuda et al. | 347/156 |
| 7,433,641 | B2 * | 10/2008 | Kikuchi et al. | 399/333 |
| 7,462,804 | B2 * | 12/2008 | Shirakata et al. | 219/619 |
| 2005/0079430 | A1 | 4/2005 | Aoki et al. | |
| 2005/0207805 | A1 * | 9/2005 | Tsueda et al. | 399/333 |
| 2006/0056889 | A1 | 3/2006 | Higaya | |
| 2007/0014601 | A1 * | 1/2007 | Yasuda et al. | 399/329 |

FOREIGN PATENT DOCUMENTS

| | | |
|---|---|---|
| JP | 2000-030850 | 1/2000 |
| JP | 2001-312168 | 11/2001 |
| JP | 2003-347030 | 12/2003 |
| JP | 2004-151470 | 5/2004 |
| JP | 2005-055680 | 3/2005 |
| JP | 2005-091422 | 4/2005 |
| WO | WO 2005/062133 | 7/2005 |

* cited by examiner

IMAGE FORMING APPARATUS AND FIXING DEVICE

PRIORITY STATEMENT

The present patent application claims priority under 35 U.S.C. §119 upon Japanese Patent Application No. 2006-112952 filed on Apr. 17, 2006 and Japanese Patent Application No. 2007-009483 filed on Jan. 18, 2007 in the Japan Patent Office, the entire contents of each of which are incorporated by reference herein.

BACKGROUND

1. Technical Field

Some example embodiments of the present invention generally relate to an image forming apparatus and/or a fixing device, for example, for fixing a toner image on a recording medium, e.g., by induction heating.

2. Description of Background Art

A background image forming apparatus, for example, a copying machine, a facsimile machine, a printer, or a multi-function printer having copying, printing, scanning, and facsimile functions, forms a toner image on a recording medium (e.g., a sheet) according to image data by an electrophotographic method. For example, a charger charges a surface of a photoconductor. An optical writer emits a light beam on the charged surface of the photoconductor to form an electrostatic latent image on the photoconductor according to image data. The electrostatic latent image is developed with a developer (e.g., toner) to form a toner image on the photoconductor; The toner image is transferred from the photoconductor onto a sheet. A fixing device applies heat and pressure to the sheet bearing the toner image to fix the toner image on the sheet. Thus, the toner image is formed on the sheet.

One example of a background fixing device uses induction heating to shorten a time period needed for the fixing device to be heated up to a proper fixing temperature after being powered on, so as to save energy. The fixing device includes a magnetic flux generator including a coil, a fixing roller including a heat generating layer, and/or a pressing roller: The magnetic flux generator opposes a part of an outer circumferential surface of the fixing roller. The pressing roller pressingly contacts another part of the outer circumferential surface of the fixing roller to form a fixing nip. At the fixing nip, the fixing roller and the pressing roller apply heat and pressure to a sheet bearing a toner image conveyed to the fixing nip to fix the toner image on the sheet. The coil extends in a width direction (i.e., a direction perpendicular to a sheet conveyance direction) of the magnetic flux generator.

For example, a power source applies a high-frequency alternating current to the coil to form an alternating magnetic field around the coil. An eddy current generates in the heat generating layer. An electric resistance of the heat generating layer generates Joule heat. The Joule heat increases the temperature of the whole fixing roller. Induction heating may heat the fixing roller up to a desired temperature in a shortened time period by consuming less energy compared to heating with a heating lamp, for example.

Another example of a background fixing device includes a magnetic flux generator, a pressing roller, and/or a fixing roller. The magnetic flux generator is disposed inside the pressing roller. The fixing roller contacts the pressing roller, and includes a temperature-sensitive, magnetic metal pipe. A member including a non-magnetic material (e.g., aluminum) having a low electric resistivity is disposed inside the temperature-sensitive, magnetic metal pipe. The temperature-sensitive, magnetic metal pipe includes a magnetic shunt alloy providing self-control of temperature. Thus, in this example fixing device, induction heating may effectively heat the fixing roller.

Yet another example of a background fixing device includes a fixing roller including a heat generating layer having various layer thicknesses in a width direction of the heat generating layer (i.e., a width direction of the fixing roller). For example, a layer thickness of a center portion of the heat generating layer in the width direction of the heat generating layer is greater than a layer thickness of both end portions of the heat generating layer in the width direction of the heat generating layer: Thus, the fixing device may provide a proper width of the fixing nip which may prevent faulty fixing.

The above-described background fixing devices may perform faulty fixing due to a varied temperature distribution in the width direction of the fixing roller. For example, both end portions of the fixing roller in the width direction of the fixing roller dissipate heat in a greater amount than a center portion of the fixing roller in the width direction of the fixing roller Especially during a warm-up period of the fixing device when the fixing device is powered on after a long time period has elapsed since the fixing device was powered off, the fixing device is heated from a relatively low temperature up to a proper fixing temperature. Accordingly, the amount of dissipated heat substantially differs between the both end portions and the center portion of the fixing roller in the width direction of the fixing roller. Namely, the temperature of the both end portions of the fixing roller is lower than the temperature of the center portion of the fixing roller in the width direction of the fixing roller.

SUMMARY

At least one embodiment of the present invention provides a fixing device for fixing a toner image on a recording medium by applying heat to the recording medium. The fixing device includes a magnetic flux generator and a heat generating member The magnetic flux generator generates a magnetic flux. The heat generating member opposes the magnetic flux generator and includes a heat generating layer The heat generating layer generates heat by the magnetic flux generated by the magnetic flux generator and has an eddy current load, obtained by dividing a volume resistivity by a layer thickness, varying depending on a position in a width direction of the heat generating layer The heat generating layer includes a magnetic layer having a Curie point in a range from about 100 degrees centigrade to about 300 degrees centigrade.

At least one embodiment of the present invention provides an image forming apparatus that includes an image carrier to carry a toner image and a fixing device (such as mentioned above regarding another embodiment of the present invention) to fix the toner image transferred from the image carrier onto a recording medium by applying at least heat to at least one of the toner image and the recording medium.

Additional features and advantages of example embodiments will be more fully apparent from the following detailed description, the accompanying drawings, and the associated claims.

BRIEF DESCRIPTION OF THE DRAWINGS

A more complete appreciation of example embodiments and the many attendant advantages thereof will be readily obtained as the same becomes better understood by reference to the following detailed description when considered in connection with the accompanying drawings, wherein.

Figure 1:
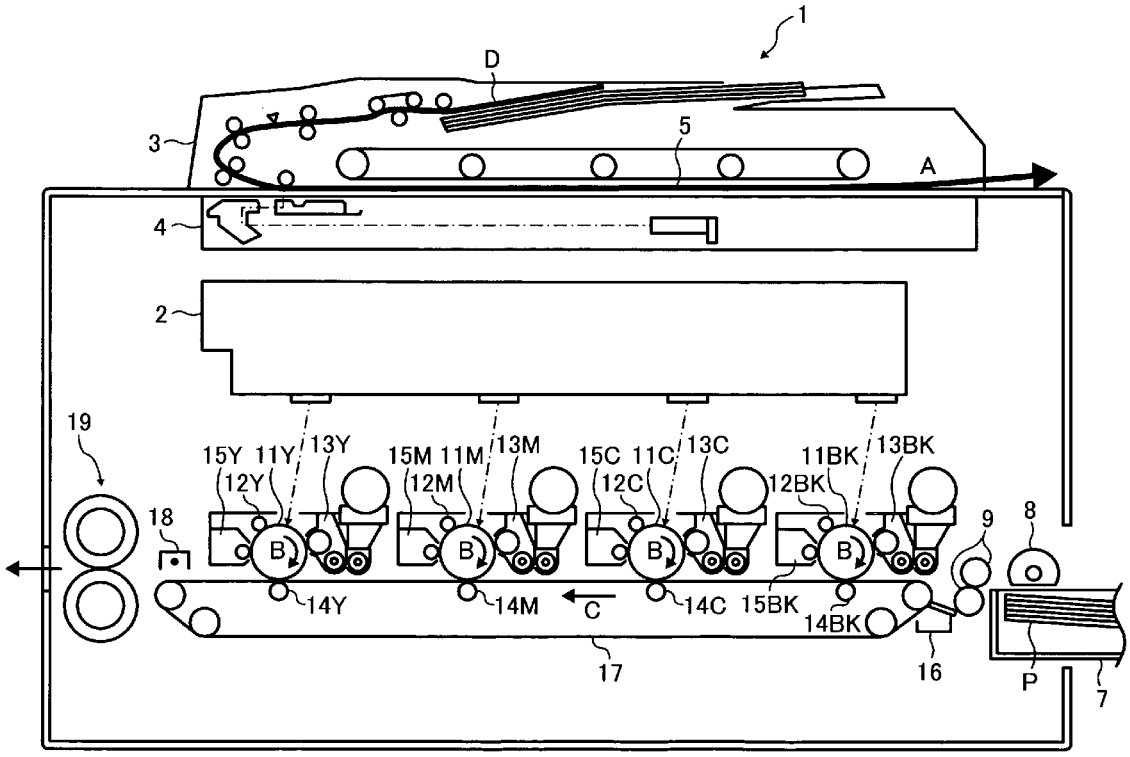
FIG. 1 is a schematic view of an image forming apparatus according to an example embodiment of the present invention.

The accompanying drawings are intended to depict example embodiments of the present invention and should not be interpreted to limit the scope thereof. The accompanying drawings are not to be considered as drawn to scale unless explicitly noted.

DETAILED DESCRIPTION OF EXAMPLE EMBODIMENTS

It will be understood that if an element or layer is referred to as being "on", "against", "connected to", or "coupled to" another element or layer, then it can be directly on, against, connected or coupled to the other element or layer, or intervening elements or layers may be present. In contrast, if an element is referred to as being "directly on", "directly connected to", or "directly coupled to" another element or layer, then there are no intervening elements or layers present. Like numbers refer to like elements throughout. As used herein, the term "and/or" includes any and all combinations of one or more of the associated listed items.

Spatially relative terms, such as "beneath", "below", "lower", "above", "upper", and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors used herein are interpreted accordingly.

Although the terms first, second, etc. may be used herein to describe various elements, components, regions, layers and/or sections, it should be understood that these elements, components, regions, layers and/or sections should not be limited by these terms. These terms are used only to distinguish one element, component, region, layer, or section from another region, layer, or section. Thus, a first element, component, region, layer, or section discussed below could be termed a second element, component, region, layer, or section without departing from the teachings of the present invention.

The terminology used herein is for the purpose of describing particular embodiments only and is not intended to be limiting of the present invention. As used herein, the singular forms "a", "an", and "the" are intended to include the plural forms as well, unless the context clearly indicates otherwise. It will be further understood that the terms "includes" and/or "including" when used in this specification, specify the presence of stated features, integers, steps, operations, elements, and/or components, but do not preclude the presence or addition of one or more other features, integers, steps, operations, elements, components, and/or groups thereof.

In describing example embodiments illustrated in the drawings, specific terminology is employed for the sake of clarity. However, the disclosure of this specification is not intended to be limited to the specific terminology so selected and it is to be understood that each specific element includes all technical equivalents that operate in a similar manner.

Referring now to the drawings, wherein like reference numerals designate identical or corresponding parts throughout the several views, particularly to FIG. 1, an image forming apparatus 1 according to an example embodiment of the present invention is explained.

As illustrated in FIG. 1, the image forming apparatus 1 includes a document feeder 3, a reader 4, a writer 2, photoconductors 11Y, 11M, 11C, and 11BK, chargers 12Y, 12M, 12C, and 12BK, development devices 13Y, 13M, 13C, and 13BK, a paper tray 7, a feeding roller 8, a registration roller pair 9, a transfer belt 17, transfer bias rollers 14Y, 14M, 14C, and 14BK, cleaners 15Y, 15M, 15C, and 15BK, a separating charger 18, a belt cleaner 16, and/or a fixing device 19. The reader 4 includes an exposure glass 5.

The image forming apparatus 1, e.g., may be a copying machine, a facsimile machine, a printer, a multifunction printer having copying, printing, scanning, and facsimile functions, or the like. As a more particular example, the image forming apparatus 1 may be a tandem type color copying machine for forming a color image on a recording medium by an electrophotographic method.

Referring to FIG. 1, the following describes operations of the image forming apparatus 1 for forming a color toner image on a recording medium.

A user places an original D on an original tray (not shown) of the document feeder 3. A feeding roller (not shown) of the document feeder 3 feeds the original D placed on the original tray in a direction A to the exposure glass 5 of the reader 4. When the original D reaches the exposure glass 5 and is thereby placed on the exposure glass 5, the reader 4 optically reads an image on the original D and sends image data created according to the read image to the writer 2.

For example, the reader 4 scans an image on the original D while a lamp (not shown) of the reader 4 emits a light beam onto the original D. The light beam reflected by the original D travels through mirrors (not shown) and a lens (not shown) of the reader 4 and forms an image in a color sensor (not shown) of the reader 4. The color sensor reads color image data in the light beam into RGB (red, green, blue) image data and converts the RGB image data into electric, RGB image signals. An image processor (not shown) of the reader 4 performs color conversion processing, color correction processing, space frequency correction processing, and/or the like based on the RGB image signals to create color image data for yellow, magenta, cyan, and black colors.

The reader 4 sends the yellow, magenta, cyan, and black image data to the writer 2. The writer 2 emits laser beams corresponding to the yellow, magenta, cyan, and black image data onto the photoconductors 11Y, 11M, 11C, and 11BK, respectively.

The four photoconductors 11Y, 11M, 11C, and 11BK, serving as image carriers, have a drum shape and rotate in a rotating direction B. In a charging process, the chargers 12Y, 12M, 12C, and 12BK uniformly charge surfaces of the photoconductors 11Y, 11M, 11C, and 11BK at positions at which the chargers 12Y, 12M, 12C, and 12BK oppose the photoconductors 11Y, 11M, 11C, and 11BK, respectively. Thus, a charging potential is formed on each of the photoconductors 11Y, 11M, 11C, and 11BK.

In an exposing process, four light sources (not shown) of the writer 2 emit laser beams corresponding to the yellow, magenta, cyan, and black image data onto the photoconductors 11Y, 11M, 11C, and 11BK, respectively. The laser beams corresponding to the yellow, magenta, cyan, and black image data travel on optical paths different from each other.

The laser beam corresponding to the yellow image data irradiates the surface of the photoconductor 11Y (i.e., a first photoconductor from the left in FIG. 1). For example, a polygon mirror (not shown) rotating at a high speed causes the laser beam corresponding to the yellow image data to scan in an axial direction of the photoconductor 11Y (i.e., a main scanning direction). Thus, an electrostatic latent image corresponding to the yellow image data is formed on the surface of the photoconductor 11Y charged by the charger 12Y.

Similarly, the laser beam corresponding to the magenta image data irradiates the surface of the photoconductor 11M (i.e., a second photoconductor from the left in FIG. 1) to form an electrostatic latent image corresponding to the magenta image data. The laser beam corresponding to the cyan image data irradiates the surface of the photoconductor 11C (i.e., a third photoconductor from the left in FIG. 1) to form an electrostatic latent image corresponding to the cyan image data. The laser beam corresponding to the black image data irradiates the surface of the photoconductor 11BK (i.e., a fourth photoconductor from the left in FIG. 1) to form an electrostatic latent image corresponding to the black image data.

When the electrostatic latent images formed on the surfaces of the photoconductors 12Y, 11M, 11C, and 11BK reach positions at which the development devices 13Y, 13M, 13C, and 13BK oppose the photoconductors 11Y, 11M, 11C, and 11BK, respectively, the development devices 13Y, 13M, 13C, and 13BK supply yellow, magenta, cyan, and black toners onto the surfaces of the photoconductors 11Y, 11M, 11C, and 11BK to develop the electrostatic latent images formed on the photoconductors 11Y, 11M, 11C, and 11BK to form yellow, magenta, cyan, and black toner images, respectively, in a developing process.

The paper tray 7 loads a recording medium (e.g., sheets P). The feeding roller 8 feeds the sheets P one by one toward the registration roller pair 9. When the sheet P passes a guide (not shown) and reaches the registration roller pair 9, the registration roller pair 9 feeds the sheet P to the transfer belt 17 at a proper time.

The transfer belt 17 rotates in a rotating direction C. The transfer bias rollers 14Y, 14M, 14C, and 14BK are disposed to contact an inner circumferential surface of the transfer belt 17 at positions at which the photoconductors 11Y, 11M, 11C, and 11BK oppose an outer circumferential surface of the transfer belt 17. When the yellow, magenta, cyan, and black toner images formed on the surfaces of the photoconductors 11Y, 11M, 11C, and 11BK reach positions at which the outer circumferential surface of the transfer belt 17 opposes the photoconductors 11Y, 11M, 11C, and 11BK, respectively, the transfer bias rollers 14Y, 14M, 14C, and 14BK transfer and superimpose the yellow, magenta, cyan, and black toner images formed on the surfaces of the photoconductors 11Y, 11M, 11C, and 11BK onto the sheet P conveyed on the outer circumferential surface of the transfer belt 17, respectively, in a transfer process. Thus, a color toner image is formed on the sheet P.

When portions on the surfaces of the photoconductors 11Y, 11M, 11C, and 11BK from which the yellow, magenta, cyan, and black toner images are transferred onto the sheet P reach positions at which the cleaners 15Y, 15M, 15C, and 15BK oppose the photoconductors 11Y, 11M, 11C, and 11BK, respectively, the cleaners 15Y, 15M, 15C, and 15BK remove toners not transferred and remaining on the surfaces of the photoconductors 11Y, 11M, 11C, and 11BK, respectively, in a cleaning process.

The portions on the surfaces of the photoconductors 11Y, 11M, 11C, and 11BK cleaned by the cleaners 15Y, 15M, 15C, and 15BK pass dischargers (not shown), respectively. Thus, a series of image forming processes performed on the photoconductors 11Y, 11M, 11C, and 11BK is completed.

The sheet P bearing the color toner image is conveyed on the transfer belt 17 toward the separating charger 18. When the sheet P reaches a position at which the separating charger 18 opposes the transfer belt 17, the separating charger 18 neutralizes electric charge stored on the sheet P so as to separate the sheet P from the transfer belt 17 without dispersing toner particles from the color toner image formed on the sheet P.

When a portion on the outer circumferential surface of the transfer belt 17 on which the sheet P has been carried reaches a position at which the belt cleaner 16 opposes the transfer belt 17, the belt cleaner 16 removes substances adhered to the outer circumferential surface of the transfer belt 17.

The sheet P separated from the transfer belt 17 is conveyed toward the fixing device 19. In the fixing device 19, a fixing roller (not shown) and a pressing roller (not shown) opposing each other nip the sheet P to fix the color toner image on the sheet P. An output roller (not shown) feeds the sheet P bearing the fixed color toner image to the outside of the image forming apparatus 1. Thus, a series of image forming processes performed by the image forming apparatus 1 is completed.

Figure 2:
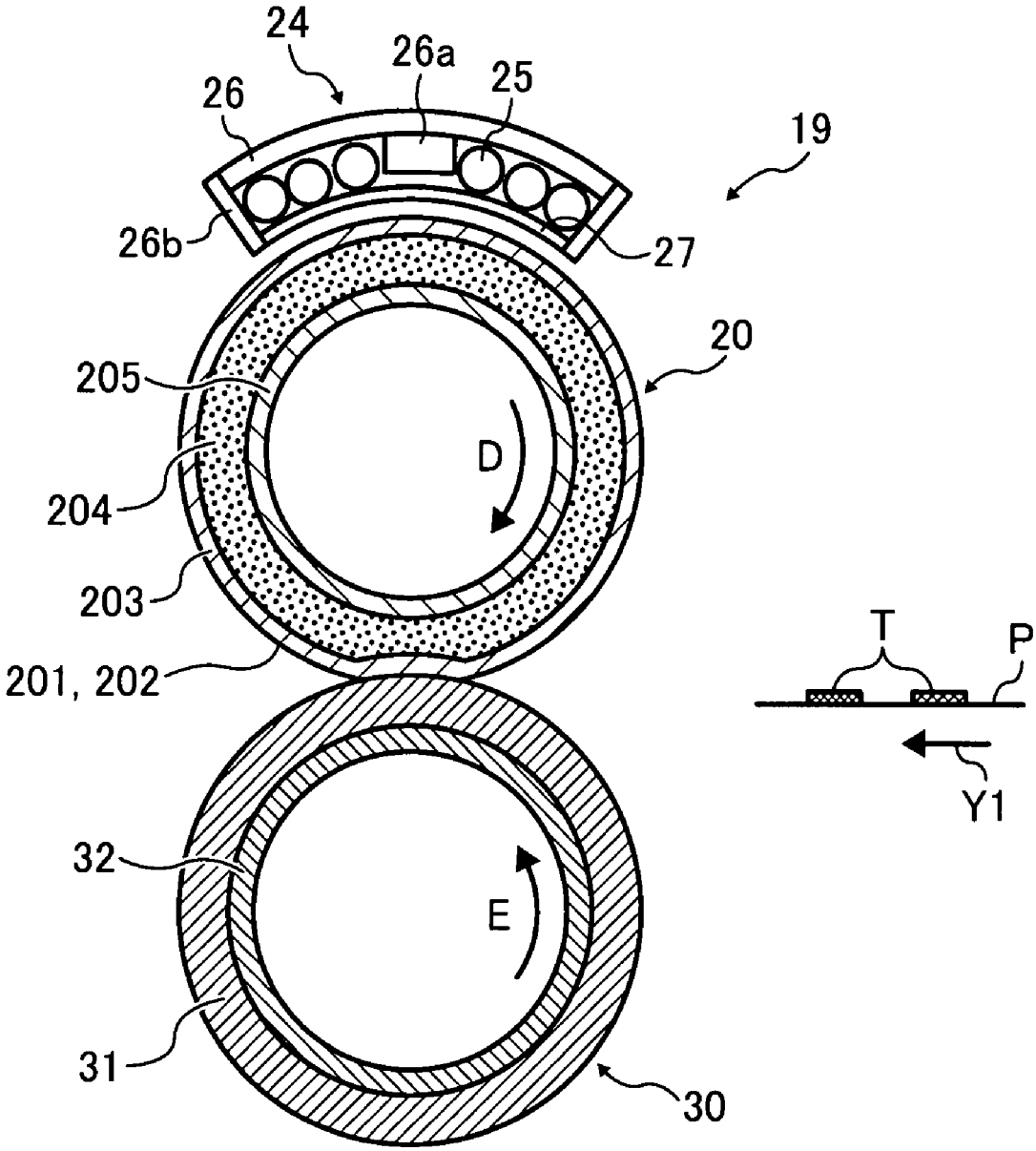
FIG. 2 is a sectional view (according to an example embodiment of the present invention) of a fixing device of the image forming apparatus shown in FIG. 1.
Figure 3:
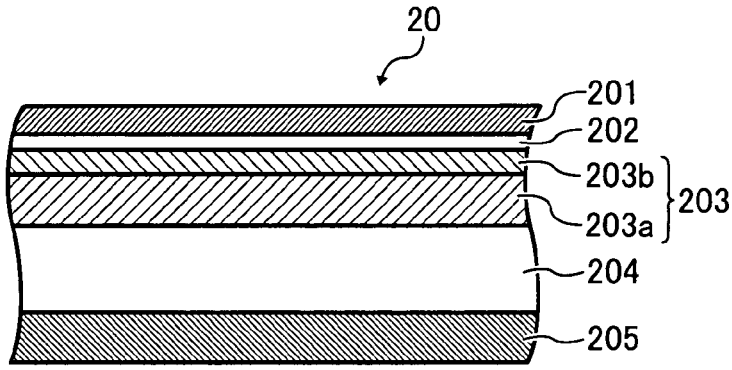
FIG. 3 is an enlarged sectional view (according to an example embodiment of the present invention) of a part of a fixing roller of the fixing device shown in FIG. 2.

Referring to FIGS. 2 and 3, the following describes a structure and operations of the fixing device 19. FIG. 2 is a sectional view of the fixing device 19. As illustrated in FIG. 2, the fixing device 19 includes a pressing roller 30, an induction heater 24, and/or a fixing roller 20. The pressing roller 30 includes a cylinder 32 and/or an elastic layer 31. The induction heater 24 includes a coil guide 27, a coil 25, and/or a core 26. The core 26 includes a center core 26*a* and/or a side core 26*b*. The fixing roller 20 includes a core 205, an elastic layer 204, a heat generating layer 203, another elastic (e.g., silicon rubber) layer 202, and/or a releasing layer 201.

The pressing roller 30 serves as a pressing member for pressing the fixing roller 20 via a sheet P bearing a toner image T. For example, the pressing roller 30 pressingly contacts the fixing roller 20 to form a fixing nip between the pressing roller 30 and the fixing roller 20. A sheet P bearing a toner image T conveyed in a direction Y1 enters the fixing nip. The induction heater 24 heats the fixing roller 20 by induction heating. The fixing roller 20 and the pressing roller 30 apply heat and pressure to the sheet P to fix the toner image T on the sheet P at the fixing nip.

The cylinder 32, e.g., includes aluminum and/or copper. The elastic layer 31, e.g., includes a fluorocarbon rubber and/or a silicon rubber, and is formed on the cylinder 32. The elastic layer 31 has a layer thickness, e.g., from about 0.5 mm to about 2.0 mm and an Asker hardness, e.g., from about 60 degrees to about 90 degrees.

The induction heater 24 serves as a magnetic flux generator for generating a magnetic flux. At least a portion of the fixing roller 20 is disposed in the magnetic flux. The induction heater 24 is disposed adjacent to and, e.g., is obversely shaped with respect to, an outer circumferential surface of the fixing roller 20. The coil guide 27 includes a heat-resistant resin. The coil guide 27 covers a part of the outer circumferential surface of the fixing roller 20 and supports the coil 25. The coil 25 may be an exciting coil, e.g., including a litz wire, e.g., formed by bundling thin wires. The litz wire is coiled and extends in a width direction (i.e., a longitudinal direction) of the fixing roller 20. The core 26 is disposed adjacent to and, e.g., is obversely shaped with respect to, the coil 25 and thus extends similarly in the width direction of the fixing roller 20. The core 26 may be an exciting coil core and includes ferromagnet (e.g., ferrite) having a relative permeability, e.g., from about 1,000 to about 3,000. The center core 26*a* and the side core 26*b* are provided in a center and a side of the core 26 in a direction perpendicular to the width direction of the fixing roller 20, respectively, so as to effectively generate a magnetic flux toward the fixing roller 20.

A thermistor (not shown) contacts the surface of the fixing roller 20. The thermistor includes a temperature-sensitive element having an increased thermal response, and detects the temperature (e.g., fixing temperature) of the fixing roller 20. The heating level of the induction heater 24 is adjusted based on a detection result provided by the thermistor.

The fixing roller 20 serves as a heat generating member for generating heat by induction heating performed by the induction heater 24. The fixing roller 20 also serves as a fixing member for melting a toner image T on a sheet P by applying heat to the sheet P. The fixing roller 20 has a multilayered structure. For example, the core 205, serving as an auxiliary layer, e.g., includes aluminum and has, e.g., a hollow, cylindrical shape. The elastic layer 204 is formed on the core 205. The heat generating layer 203 is formed on the elastic layer 204. The silicon rubber layer 202 is formed on the heat generating layer 203. The releasing layer 201 (e.g., a PFA (perfluoroalkoxy) layer) is formed on the silicon rubber layer 202.

FIG. 3 is a sectional view of a part of the fixing roller 20. As illustrated in FIG. 3, the heat generating layer 203 of the fixing roller 20 includes a magnetic layer 203*a* and/or a low resistance layer 203*b*.

In addition to a function for maintaining a strength of the whole fixing roller 20, the core 205 provides a function for serving as an auxiliary layer (e.g., a demagnetizing layer in sense of exhibiting at least reduced ferromagnetic properties relative to the magnetic layer 203*a*, if not exhibiting paramagnetic properties or non-magnetic properties) for supporting an effective action of self-control of the temperature of the magnetic layer 203*a*. For example, the core 205 is provided at a position in the fixing roller 20, that is, on an inner circumferential side relative to the heat generating layer 203. The core 205 has a volume resistivity lower than a volume resistivity of the magnetic layer 203*a* (e.g., a magnetic shunt alloy layer). For example, the core 205 has a volume resistivity, e.g., not greater than about $1.0\times10^{-7}$ Ω·m and more particularly, e.g., has a volume resistivity not greater than about $5.0\times10^{-8}$ Ω·m. To satisfy the above-described conditions, the core 205 can, e.g., include aluminum.

Figure 4A:
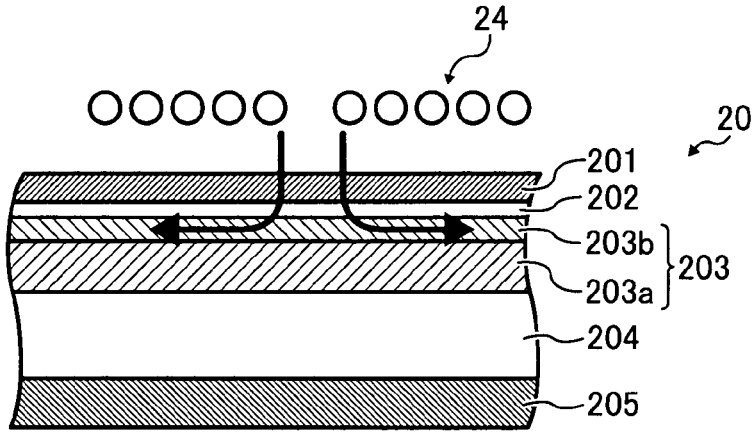
FIG. 4A is a sectional view (according to an example embodiment of the present invention) of the fixing roller shown in FIG. 3 for illustrating a flow of a magnetic flux.
Figure 4B:
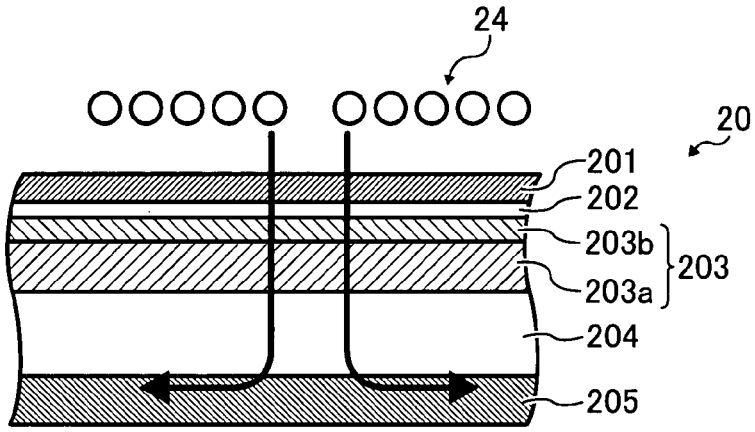
FIG. 4B is a sectional view (according to an example embodiment of the present invention) of the fixing roller shown in FIG. 3 for illustrating another flow of a magnetic flux.

When the core 205 is configured as described above, the magnetic layer 203*a* including the magnetic shunt alloy provides an improved self-control of the temperature. For example, when the temperature of the magnetic layer 203*a* does not reach a Curie point, a magnetic flux generated by the induction heater 24 is concentrated in the heat generating layer 203, as illustrated by arrows in FIG. 4A. Thus, the heat generating layer 203 is sufficiently heated by induction heating. When the temperature of the magnetic layer 203*a* reaches a Curie point (i.e., the temperature at which the magnetic layer 203*a* loses its magnetism, or in other words, exhibits paramagnetic properties instead of ferromagnetic properties), a magnetic flux generated by the induction heater 24 penetrates the heat generating layer 203 and reaches the core 205, as illustrated by arrows in FIG. 4B. Thus, the heat generating layer 203 is not sufficiently heated by induction heating. Namely, when the temperature of the magnetic layer 203*a* reaches a Curie point, the core 205 functions as a demagnetizing layer.

As illustrated in FIG. 3, according to this example embodiment, the core 205 including aluminum is used as an auxiliary layer. Alternatively, an auxiliary layer may be provided on an outer circumferential side relative to a core, e.g., stainless steel. Namely, the auxiliary layer is sandwiched between the core and a heat generating layer. In this case, the auxiliary layer may also provide the above-described effects provided by the core 205 serving as an auxiliary layer.

The elastic layer 204 is sandwiched between the heat generating layer 203 and the core 205. According to this example embodiment, the elastic layer 204 includes an elastic material (e.g., a silicon rubber), and has a layer thickness, e.g., not greater than about 5 mm. Thus, the elastic layer 204 is deformable to provide a fixing nip formed between the fixing roller 20 and the pressing roller 30 (depicted in FIG. 2) opposing each other. As a result, a sheet P is properly separated from the fixing roller 20 and the pressing roller 30 after the fixing roller 20 and the pressing roller 30 fix a toner image T on the sheet P. The heat generating layer 203 and the core 205 are not positioned far from each other, resulting in the above-described effects provided by the core 205. Namely, the layer thickness of the elastic layer 204 can be determined, e.g., to satisfy both a proper separation of a sheet P from the fixing roller 20 and the pressing roller 30 and a proper self-control of the temperature of the fixing roller 20.

The heat generating layer 203 includes the magnetic layer 203*a* and/or the low resistance layer 203*b*. The magnetic layer 203*a* has a Curie point in a range, e.g., from about 100 degrees centigrade to about 300 degrees centigrade, for example, a temperature a bit higher than an upper limit of a target fixing temperature. The magnetic layer 203*a* includes magnetic shunt alloys (e.g., an iron-nickel alloy, a copper-nickel alloy, a nickel-iron-chrome alloy, and/or the like). As described above, when the heat generating layer 203 includes the magnetic layer 203*a* having a reference Curie point, the fixing roller 20 is properly heated by induction heating without being excessively heated. The magnetic layer 203*a* may have a desired Curie point when an amount of materials and processing conditions are adjusted.

The low resistance layer 203*b* provided on an outer circumferential side (e.g., a side facing the induction heater 24 depicted in FIG. 2) from the magnetic layer 203*a* has a volume resistivity, e.g., not greater than about $1.0\times10^{-7}$ Ω·m and more particularly, e.g., has a volume resistivity not greater than about $5.0\times10^{-8}$ Ω·m. According to this example embodiment, the low resistance layer 203*b* has a volume resistivity, e.g., of about $1.7\times10^{-8}$ Ω·m and includes a non-magnetic material (e.g., copper). The heat generating layer 203 is heated by induction heating caused by a magnetic flux generated by the induction heater 24, when the magnetic layer 203*a* does not reach a Curie point.

Figure 5:
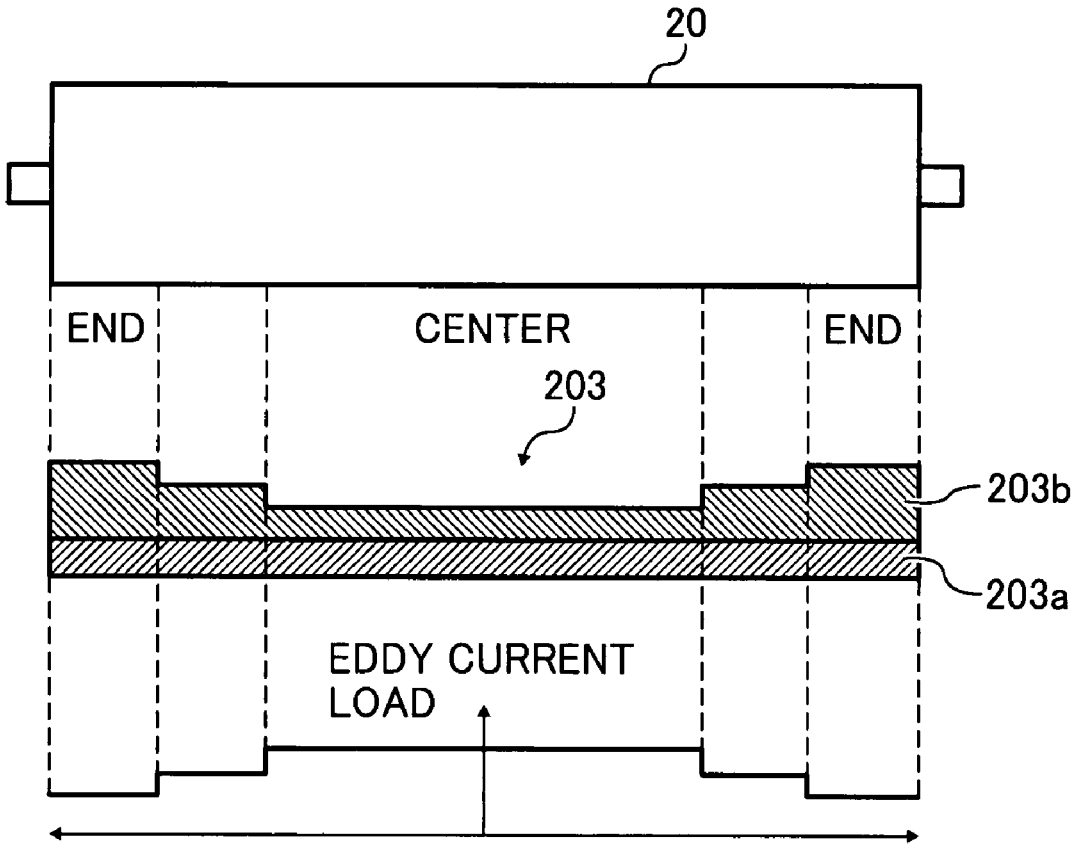
FIG. 5 is a sectional view (according to an example embodiment of the present invention) of a heat generating layer of the fixing roller shown in FIG. 3 corresponding to a width direction of the fixing roller.

According to this example embodiment, in the heat generating layer 203, an eddy current load obtained by dividing a volume resistivity by a layer thickness varies depending on a position in the width direction (again, along the longitudinal axis) of the fixing roller 20 (i.e., a width direction of the heat generating layer 203). As illustrated in FIG. 5, the magnetic layer 203*a* has a uniform layer thickness in the width direction (i.e., a thrust direction or an axial direction) of the fixing roller 20. The low resistance layer 203*b* has a layer thickness varying depending on a position in the width direction of the fixing roller 20. The heat generating layer 203 has a uniform volume resistivity in the width direction of the fixing roller 20.

As illustrated in FIG. 3, the silicon rubber layer 202 has a layer thickness, e.g., not greater than about 500 μm. The silicon rubber layer 202 prevents oxidation of the low resistance layer 203*b* (which can include, e.g., copper), and provides elasticity near the outer circumferential surface of the fixing roller 20.

The releasing layer 201 includes, e.g., a fluorochemical (e.g., PFA) and has a layer thickness, e.g., of about 30 μm. The releasing layer 201 increases a toner releasing property on the outer circumferential surface of the fixing roller 20 directly touching a toner image T on a sheet P (depicted in FIG. 2).

As described above, the fixing roller 20 has a multilayered structure including a plurality of layers (e.g., the core 205, the elastic layer 204, the heat generating layer 203, the silicon rubber layer 202, and/or the releasing layer 201). The layer thickness of the plurality of layers of the fixing roller 20 is substantially uniform in the width direction of the fixing roller 20 (i.e., a direction perpendicular to a conveyance direction of a sheet P). Accordingly, the fixing roller 20 has a flat surface, providing proper fixing of a toner image T on a sheet P and a proper conveyance of a sheet P.

Referring to FIG. 2, the following describes operations of the fixing device 19. When a driving motor (not shown) rotates the fixing roller 20 in a rotating direction D, the pressing roller 30 rotates in a rotating direction E. A magnetic flux generated by the induction heater 24 heats the fixing roller 20 at an opposing position at which the induction heater 24 opposes the fixing roller 20.

For example, a power source (not shown) applies a current, e.g., a high-frequency alternating current, in a range, e.g., from about 10 kHz to about 1 MHz (more particularly, e.g., in a range from about 20 kHz to about 800 kHz) to the coil 25. Magnetic lines of force are formed toward the heat generating layer 203. Directions of the magnetic lines of force alternately switch in opposite directions to form an alternating magnetic field. When the magnetic layer 203*a* (depicted in FIG. 3) has a temperature not greater than a Curie point, an eddy current generates in the heat generating layer 203. An electric resistance of the heat generating layer 203 generates Joule heat. Thus, the fixing roller 20 is heated by the Joule heat generated by the heat generating layer 203.

A portion on the outer circumferential surface of the fixing roller 20 heated by the induction heater 24 rotates to a contact position (e.g., the fixing nip) at which the fixing roller 20 contacts the pressing roller 30. At the contact position, the fixing roller 20 applies heat to a sheet P conveyed in the direction Y1 to melt a toner image T on the sheet P.

For example, a guide (not shown) guides a sheet P bearing a toner image T formed in the above-described image forming processes to the fixing nip formed between the fixing roller 20 and the pressing roller 30. Thus, the sheet P is conveyed in the direction Y1 and enters the fixing nip. At the fixing nip, the fixing roller 20 and the pressing roller 30 apply heat and pressure to the sheet P to fix the toner image T on the sheet P. The sheet P bearing the fixed toner image T moves out of the fixing nip.

The portion on the outer circumferential surface of the fixing roller 20 heated by the induction heater 24 reaches the opposing position at which the induction heater 24 opposes the fixing roller 20 again after moving out of the fixing nip. The above-described operations of the fixing device 19 are repeated to complete a fixing process in an image forming process.

In the fixing process, when the magnetic layer 203*a* has a temperature greater than a Curie point, a heat generating level of the heat generating layer 203 is restricted. For example, the temperature of the magnetic layer 203*a* heated by the induction heater 24 exceeds a Curie point, the magnetic layer 203*a* loses its magnetism, and thereby generation of an eddy current is restricted near a surface of the heat generating layer 203. Thus, Joule heat in a decreased amount generates in the heat generating layer 203, preventing the heat generating layer 203 from being excessively heated.

In the fixing device 19 according to this example embodiment, an eddy current load in the heat generating layer 203 varies depending on a position in the width direction of the fixing roller 20 (i.e., the width direction of the heat generating layer 203).

Figure 6:
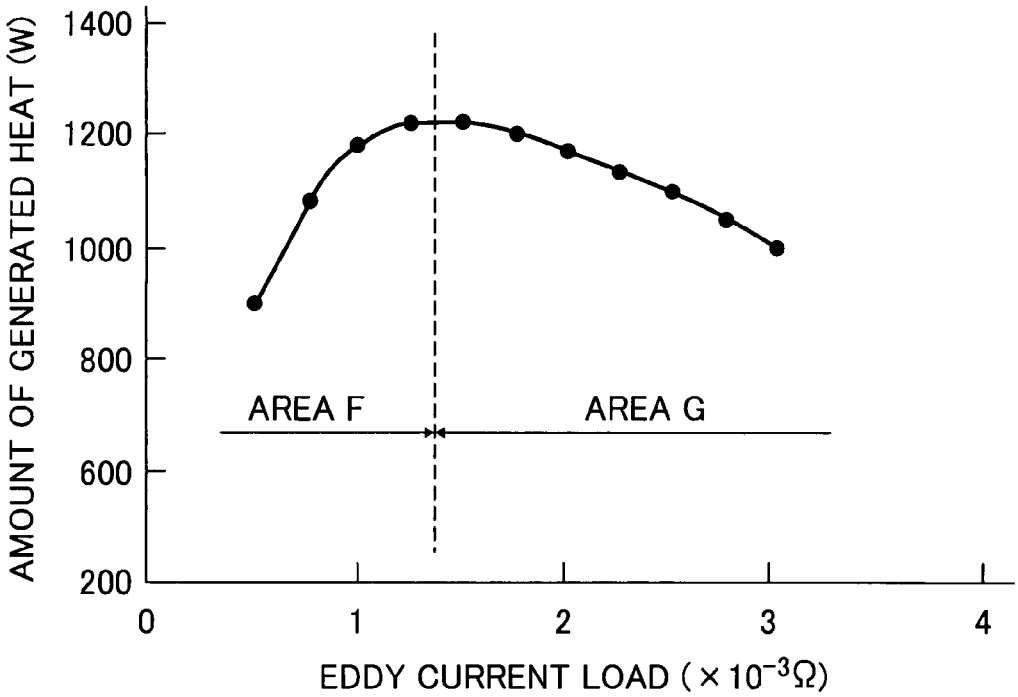
FIG. 6 is a graph (according to an example embodiment of the present invention) illustrating a relationship between an eddy current load and an amount of generated heat of the heat generating layer shown in FIG. 5.

Referring to FIGS. 5 and 6, the following describes the eddy current load in the heat generating layer 203. FIG. 5 illustrates a front view of the fixing roller 20 taken along the width direction (i.e., the longitudinal direction) of the fixing roller 20. FIG. 5 further illustrates a sectional view of the heat generating layer 203 corresponding to the width direction of the fixing roller 20. FIG. 5 further illustrates a graph showing an eddy current load of the heat generating layer 203 corresponding to the width direction of the fixing roller 20. FIG. 6 is a graph illustrating a relationship between an eddy current load and an amount of generated heat of the heat generating layer 203 when the power source applies a current, e.g., a high-frequency alternating current, e.g., of about 30 kHz, to the coil 25 (depicted in FIG. 2).

The eddy current load is a factor determining a heat generating property of the heat generating layer 203 and is calculated according to an Equation 1 below. In the Equation 1, "d" represents an eddy current load of the heat generating layer 203. "ρ" represents a volume resistivity of the heat generating layer 203. "t" represents a layer thickness of the heat generating layer 203.

$$d=\rho/t \qquad \text{Equation 1}$$

However, when the layer thickness t of the heat generating layer 203 is greater than a skin thickness (e.g., a permeance depth) of the heat generating layer 203, a magnetic flux does not penetrate the heat generating layer 203 and the eddy current load d is calculated according to an Equation 2 below. In the Equation 2, "δ" represents a skin thickness of the heat generating layer 203.

$$d=\rho/\delta \qquad \text{Equation 2}$$

The skin thickness δ is calculated according to an Equation 3 below. In the Equation 3, "ρ'" represents a volume resistivity of a material. "μ" represents a relative permeability of a material. "f" represents a frequency of an alternating current for exciting a material.

$$\delta = 5.03(10^3) * \sqrt{\frac{\rho'}{\mu f}} \qquad \text{Equation 3}$$

As illustrated in FIG. 6, the amount of heat generated by the heat generating layer 203 (depicted in FIG. 5) does not proportionally increase as the eddy current load increases. For example, when the eddy current load is not greater than a reference value (e.g., when the eddy current load is in a range illustrated in an area F), the amount of generated heat of the heat generating layer 203 increases as the eddy current load increases. When the eddy current load is not smaller than a reference value (e.g., when the eddy current load is in a range illustrated in an area G), the amount of generated heat of the heat generating layer 203 decreases as the eddy current load increases.

According to this example embodiment, the eddy current load of the heat generating layer 203 is set in the range illustrated in the area G. As illustrated in FIG. 5, a center portion of the heat generating layer 203 in the width direction of the fixing roller 20 has an eddy current load greater than an eddy current load of both end portions of the heat generating layer 203 in the width direction of the fixing roller 20. Namely, according to this example embodiment, the heat generating layer 203 has an eddy current load of three levels. For example, the low resistance layer 203*b* has a layer thickness varying in the width direction of the fixing roller 20. Thus, the eddy current load of the center portion of the heat generating layer 203 is greater than the eddy current load of the both end portions of the heat generating layer 203 in the width direction of the fixing roller 20.

The both end portions of the heat generating layer 203 in the width direction of the fixing roller 20 may have a decreased temperature. To address this problem, the both end portions have a decreased eddy current load. Thus, the heat generating layer 203 may have a uniform temperature distribution (i.e., a uniform amount of generated heat) in the width direction of the fixing roller 20.

Figure 7:
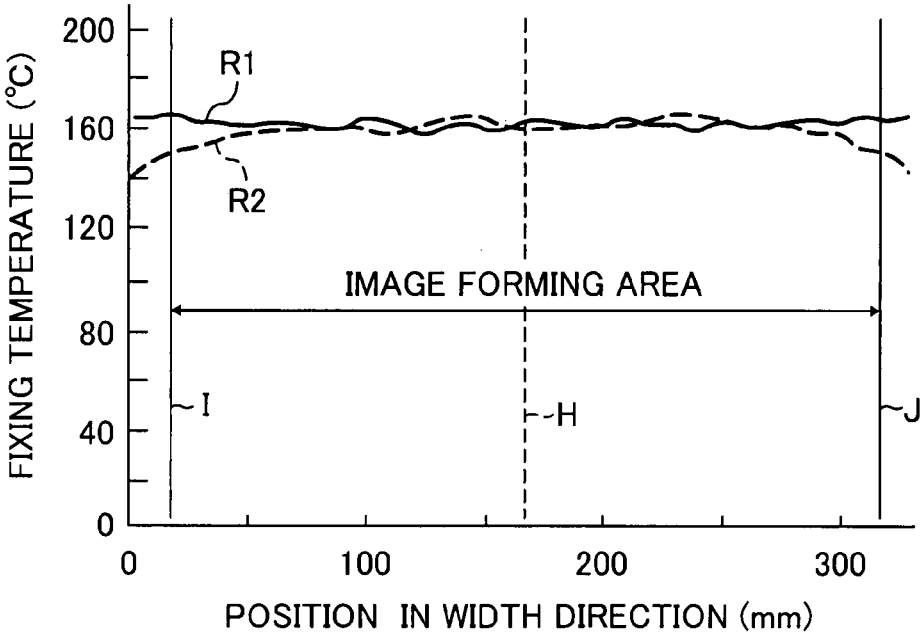
FIG. 7 is a graph (according to an example embodiment of the present invention) illustrating a relationship between a position in a width direction of the fixing roller shown in FIG. 3 and a fixing temperature.

FIG. 7 illustrates a result of an experiment for examining effects of this example embodiment. In FIG. 7, a horizontal axis represents a position in the width direction of the fixing roller 20 (depicted in FIG. 5). A line H represents a center position in the width direction of the fixing roller 20. Lines I and J represent both end positions of an image forming area in the width direction of the fixing roller 20. A vertical axis represents a surface temperature (e.g., a fixing temperature) of the fixing roller 20. A graph R1 illustrates a fixing temperature distribution when the fixing roller 20 of the fixing device 19 (depicted in FIG. 2) according to this example embodiment is used. A graph R2 illustrates a fixing temperature distribution when the magnetic layer 203*a* (depicted in FIG. 5) having a uniform layer thickness in the width direction of the fixing roller 20 is used. The graphs R1 and R2 show that the fixing roller 20 has a uniform temperature distribution in the width direction of the fixing roller 20 when the eddy current load of the heat generating layer 203 (depicted in FIG. 5) may be optimized according to a position in the width direction of the fixing roller 20.

According to this example embodiment, when an eddy current load obtained by dividing a volume resistivity by a layer thickness of the heat generating layer 203 is optimized according to a position in the width direction of the fixing roller 20, the layer thickness of the low resistance layer 203*b* (depicted in FIG. 5) is a variable, and the volume resistivity of the heat generating layer 203 and the layer thickness of the magnetic layer 203*a* are constants. However, at least one of the layer thickness of the magnetic layer 203*a*, the volume resistivity of the magnetic layer 203*a*, the layer thickness of the low resistance layer 203*b*, and the volume resistivity of the low resistance layer 203*b* may be a variable, so as to optimize the eddy current load of the whole heat generating layer 203 according to a position in the width direction of the fixing roller 20.

As illustrated in FIG. 2, the fixing device 19 according to this example embodiment uses an induction heating method and includes the fixing roller 20 including the heat generating layer 203 including the magnetic layer 203*a* (depicted in FIG. 3) having a reference Curie point. Thus, the eddy current load of the heat generating layer 203 varies depending on a position in the width direction of the fixing roller 20. Thus, the fixing roller 20 may provide an improved heating efficiency with a relatively simple structure, a uniform temperature distribution in the width direction of the fixing roller 20 when heated by the induction heater 24, proper fixing of a toner image T on a sheet P, and proper prevention of an excessively increased temperature of the fixing roller 20.

According to this example embodiment, the fixing roller 20 is used as the heat generating member. However, the pressing roller 30, in addition to the fixing roller 20, may be used as the heat generating member so as to improve a fixing property of the fixing device 19. In this case, the pressing roller 30 includes a heat generating layer including a magnetic layer having a reference Curie point. A magnetic flux generator is provided at a position opposing the pressing roller 30. The pressing roller 30 may provide the effects provided by the fixing roller 20 according to this example embodiment, when the eddy current load of the heat generating layer of the pressing roller 30 varies depending on a position in a width direction (i.e., a longitudinal direction) of the pressing roller 30 or the heat generating layer.

Figure 8:
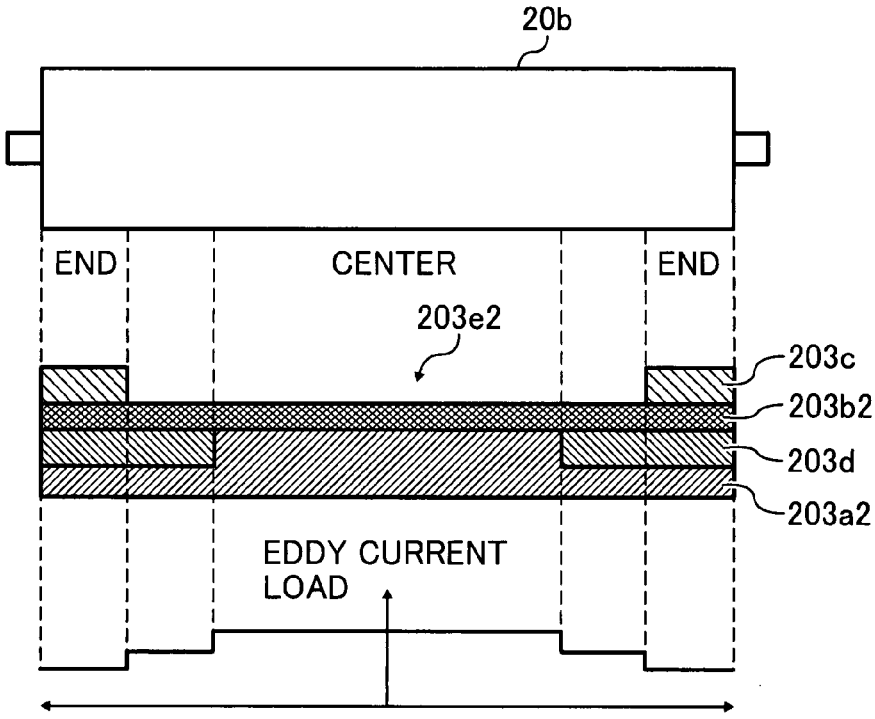
FIG. 8 is a sectional view of a heat generating layer of a fixing roller corresponding to a width direction of the fixing roller according to another example embodiment of the present invention.

Referring to FIG. 8, the following describes a fixing roller 20*b* including a heat generating layer 203*e*2 according to another example embodiment of the present invention. FIG. 8 illustrates a front view of the fixing roller 20*b* taken along a longitudinal direction (i.e., a width direction) of the fixing roller 20*b*. FIG. 8 further illustrates a sectional view of the heat generating layer 203*e*2 corresponding to the width direction of the fixing roller 20*b*. FIG. 8 further illustrates a graph showing an eddy current load of the heat generating layer 203*e*2 corresponding to the width direction of the fixing roller 20*b*.

Like the fixing roller 20 (depicted in FIG. 3), the fixing roller 20*b*, serving as the heat generating member and the fixing member, includes the core 205 serving as the auxiliary layer, the elastic layer 204, the heat generating layer 203*e*2, the silicon rubber layer 202, and/or the releasing layer 201 layered in this order. However, the heat generating layer 203*e*2 has a structure different from the structure of the heat generating layer 203 (depicted in FIG. 5). For example, the heat generating layer 203*e*2 includes a magnetic layer 203*a*2, a low resistance layer 203*b*2, a second low resistance layer 203*c*, and/or a third low resistance layer 203*d*. The magnetic layer 203*a*2 and the low resistance layer 203*b*2 have structures common to the magnetic layer 203*a* and the low resistance layer 203*b* (depicted in FIG. 5), respectively, except shapes of the magnetic layer 203*a*2 and the low resistance layer 203*b*2. Like the low resistance layer 203*b*, the second low resistance layer 203*c* and the third low resistance layer 203*d* have a volume resistivity, e.g., not greater than about $5.0\times10^{-8}$ Ω·m. Namely, the heat generating layer 203*e*2 includes the low resistance layer 203*b*2, the second low resistance layer 203*c*, and the third low resistance layer 203*d* including three different materials, respectively.

Like the heat generating layer 203 (depicted in FIG. 5), according to this example embodiment, an eddy current load of the heat generating layer 203*e*2 is set in the range illustrated in the area G in FIG. 6. As illustrated in FIG. 8, a center portion of the heat generating layer 203*e*2 in the width direction of the fixing roller 20*b* (i.e., a width direction of the heat generating layer 203*e*2) has an eddy current load greater than an eddy current load of both end portions of the heat generating layer 203*e*2 in the width direction of the fixing roller 20*b*. Namely, according to this example embodiment, the heat generating layer 203*e*2 has eddy current loads of three levels. For example, the magnetic layer 203*a*2, the low resistance layer 203*b*2, the second low resistance layer 203*c*, and the third low resistance layer 203*d* have volume resistivities different from each other. Thus, the eddy current load of the center portion of the heat generating layer 203*e*2 is greater than the eddy current load of the both end portions of the heat generating layer 203*e*2 in the width direction of the fixing roller 20*b*. The layer thickness of the magnetic layer 203*a*2 varies depending on a position in the width direction of the fixing roller 20*b*. The low resistance layer 203*b*2 has a uniform layer thickness. The second low resistance layer 203*c* and the third low resistance layer 203*d* are formed at reference positions in the width direction of the fixing roller 20*b*, respectively.

The both end portions of the heat generating layer 203*e*2 in the width direction of the fixing roller 20*b* may have a decreased temperature. To address this problem, the both end portions have a decreased eddy current load. Thus, the heat generating layer 203*e*2 may have a uniform temperature distribution (i.e., a uniform amount of generated heat) in the width direction of the fixing roller 20*b*, as illustrated in the area G in FIG. 6.

As described above, the fixing roller 20*b* according to this example embodiment illustrated in FIG. 8, like the fixing roller 20 depicted in FIG. 5, includes the heat generating layer 203*e*2 including the magnetic layer 203*a*2 having a reference Curie point. The eddy current load of the heat generating layer 203*e*2 varies depending on a position in the width direction of the fixing roller 20*b*. Thus, the fixing roller 20*b* may provide an improved heating efficiency with a relatively simple structure, a uniform temperature distribution in the width direction of the fixing roller 20*b* when heated by the induction heater 24 (depicted in FIG. 2) serving as the magnetic flux generator, proper fixing of a toner image T on a sheet P, and proper prevention of an excessively increased temperature of the fixing roller 20*b*.

Figure 9:
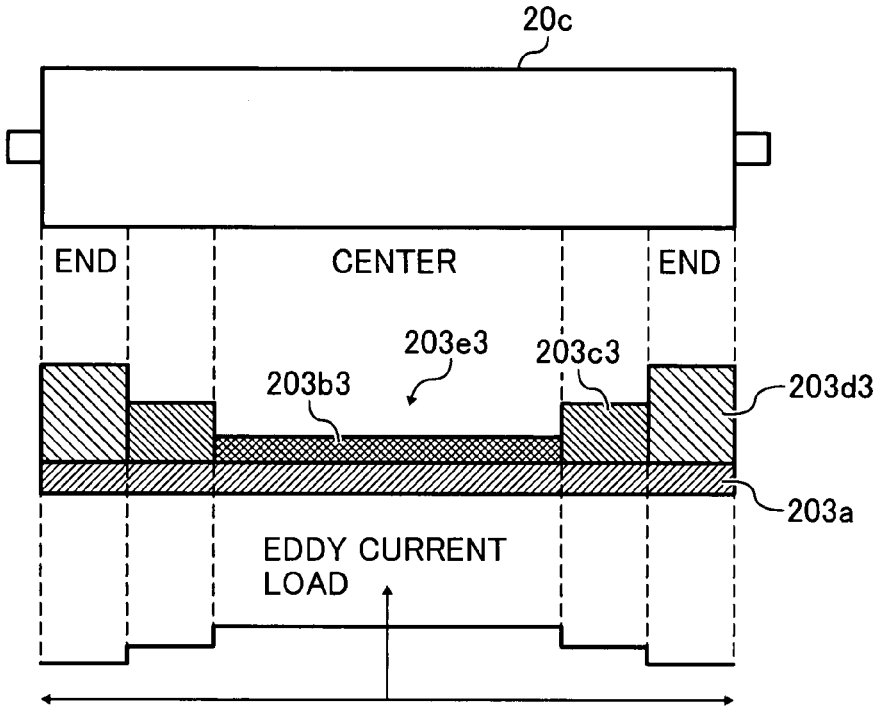
FIG. 9 is a sectional view of a heat generating layer of a fixing roller corresponding to a width direction of the fixing roller according to yet another example embodiment of the present invention.

Referring to FIG. 9, the following describes a fixing roller 20*c* including a heat generating layer 203*e*3 according to yet another example embodiment of the present invention. FIG. 9 illustrates a front view of the fixing roller 20*c* taken along a longitudinal direction (i.e., a width direction) of the fixing roller 20*c*. FIG. 9 further illustrates a sectional view of the heat generating layer 203*e*3 corresponding to the width direction of the fixing roller 20*c*. FIG. 9 further illustrates a graph showing an eddy current load of the heat generating layer 203*e*3 corresponding to the width direction of the fixing roller 20*c*.

Like the fixing roller 20 (depicted in FIG. 3), the fixing roller 20*c*, serving as the heat generating member and the fixing member, includes the core 205 serving as the auxiliary layer, the elastic layer 204, the heat generating layer 203*e*3, the silicon rubber layer 202, and/or the releasing layer 201 layered in this order. However, the heat generating layer 203*e*3 has a structure different from the structure of the heat generating layer 203 (depicted in FIG. 5). For example, the heat generating layer 203*e*3 includes the magnetic layer 203*a*, a low resistance layer 203*b*3, a second low resistance layer 203*c*3, and/or a third low resistance layer 203*d*3. The low resistance layer 203*b*3, the second low resistance layer 203*c*3, and the third low resistance layer 203*d*3 have structures common to the structures of the low resistance layer 203*b* (depicted in FIG. 5), the second low resistance layer 203*c* (depicted in FIG. 8), and the third low resistance layer 203*d* (depicted in FIG. 8), respectively, except shapes of the low resistance layer 203*b*3, the second low resistance layer 203*c*3, and the third low resistance layer 203*d*3. Like the low resistance layer 203*b*, the second low resistance layer 203*c*3 and the third low resistance layer 203*d*3 have a volume resistivity, e.g., not greater than about $5.0\times10^{-8}$ Ω·m. Namely, the heat generating layer 203*e*3 includes the low resistance layer 203*b*3, the second low resistance layer 203*c*3, and the third low resistance layer 203*d*3 including three different materials, respectively.

Like the heat generating layer 203 (depicted in FIG. 5), according to this example embodiment, an eddy current load of the heat generating layer 203*e*3 is set in the range illustrated in the area G in FIG. 6. As illustrated in FIG. 9, a center portion of the heat generating layer 203*e*3 in the width direction of the fixing roller 20*c* (i.e., a width direction of the heat generating layer 203*e*3) has an eddy current load greater than an eddy current load of both end portions of the heat generating layer 203*e*3 in the width direction of the fixing roller 20*c*. Namely, according to this example embodiment, the heat generating layer 203*e*3 has eddy current loads of three levels. For example, the magnetic layer 203*a*, the low resistance layer 203*b*3, the second low resistance layer 203*c*3, and the third low resistance layer 203*d*3 have volume resistivities different from each other. Thus, the eddy current load of the center portion of the heat generating layer 203*e*3 in the width direction of the fixing roller 20*c* is greater than the eddy current load of the both end portions of the heat generating layer 203*e*3 in the width direction of the fixing roller 20*c*. The magnetic layer 203*a* has a uniform layer thickness. The low resistance layer 203*b*3, the second low resistance layer 203*c*3, and the third low resistance layer 203*d*3 are formed at reference positions in the width direction of the fixing roller 20*c*, respectively.

The both end portions of the heat generating layer 203*e*3 in the width direction of the fixing roller 20*c* may have a decreased temperature. To address this problem, the both end portions have a decreased eddy current load. Thus, the heat generating layer 203*e*3 may have a uniform temperature distribution (i.e., a uniform amount of generated heat) in the width direction of the fixing roller 20*c*, as illustrated in the area G in FIG. 6.

As described above, the fixing roller 20*c* according to this example embodiment illustrated in FIG. 9, like the fixing roller 20 depicted in FIG. 5, includes the heat generating layer 203*e*3 including the magnetic layer 203*a* having a reference Curie point. The eddy current load of the heat generating layer 203*e*3 varies depending on a position in the width direction of the fixing roller 20*c*. Thus, the fixing roller 20*c* may provide an improved heating efficiency with a relatively simple structure, a uniform temperature distribution in the width direction of the fixing roller 20*c* when heated by the induction heater 24 (depicted in FIG. 2) serving as the magnetic flux generator, proper fixing of a toner image T on a sheet P, and proper prevention of an excessively increased temperature of the fixing roller 20*c*.

Figure 10:
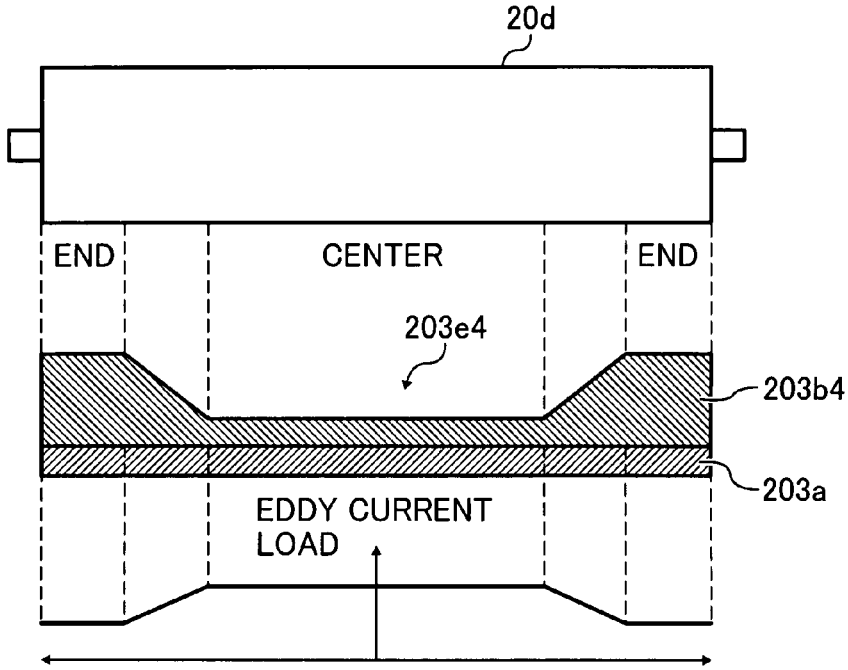
FIG. 10 is a sectional view of a heat generating layer of a fixing roller corresponding to a width direction of the fixing roller according to yet another example embodiment of the present invention.

Referring to FIG. 10, the following describes a fixing roller 20*d* including a heat generating layer 203*e*4 according to yet another example embodiment of the present invention. FIG. 10 illustrates a front view of the fixing roller 20*d* taken along a longitudinal direction (i.e., a width direction) of the fixing roller 20*d*. FIG. 10 further illustrates a sectional view of the heat generating layer 203*e*4 corresponding to the width direction of the fixing roller 20*d*. FIG. 10 further illustrates a graph showing an eddy current load of the heat generating layer 203*e*4 corresponding to the width direction of the fixing roller 20*d*.

Like the fixing roller 20 (depicted in FIG. 3), the fixing roller 20*d*, serving as the heat generating member and the fixing member, includes the core 205 serving as the auxiliary layer, the elastic layer 204, the heat generating layer 203*e*4, the silicon rubber layer 202, and/or the releasing layer 201 layered in this order. However, the heat generating layer 203*e*4 has a structure different from the structure of the heat generating layer 203 (depicted in FIG. 5). For example, the heat generating layer 203*e*4 includes the magnetic layer 203*a* and/or a low resistance layer 203*b*4. The low resistance layer 203*b*4 has a structure common to the structure of the low resistance layer 203*b* (depicted in FIG. 5), except a shape of the low resistance layer 203*b*4. For example, the low resistance layer 203*b*4 has a layer thickness that gradually varies. Namely, the low resistance layer 203*b*4 includes a thick portion having a thick layer thickness, a thin portion having a thin layer thickness, and/or a tapered portion. The tapered portion is provided between the thick portion and the thin portion. In the tapered portion, the layer thickness of the low resistance layer 203*b*4 gradually decreases from the layer thickness of the thick portion to the layer thickness of the thin portion.

Like the heat generating layer 203 (depicted in FIG. 5), according to this example embodiment, an eddy current load of the heat generating layer 203*e*4 is set in the range illustrated in the area G in FIG. 6. As illustrated in FIG. 10, a center portion of the heat generating layer 203*e*4 in the width direction of the fixing roller 20*d* (i.e., a width direction of the heat generating layer 203*e*4) has an eddy current load greater than an eddy current load of both end portions of the heat generating layer 203*e*4 in the width direction of the fixing roller 20*d*. Namely, according to this example embodiment, the heat generating layer 203*e*4 has an eddy current load that gradually varies.

The both end portions of the heat generating layer 203*e*4 in the width direction of the fixing roller 20*d* may have a decreased temperature. To address this problem, the both end portions have a decreased eddy current load. Thus, the heat generating layer 203*e*4 may have a uniform temperature distribution (i.e., a uniform amount of generated heat) in the width direction of the fixing roller 20*d*, as illustrated in the area G in FIG. 6.

As described above, the fixing roller 20*d* according to this example embodiment illustrated in FIG. 10, like the fixing roller 20 depicted in FIG. 5, includes the heat generating layer 203*e*4 including the magnetic layer 203*a* having a reference Curie point. The eddy current load of the heat generating layer 203*e*4 varies depending on a position in the width direction of the fixing roller 20*d*. Thus, the fixing roller 20*d* may provide an improved heating efficiency with a relatively simple structure, a uniform temperature distribution in the width direction of the fixing roller 20*d* when heated by the induction heater 24 (depicted in FIG. 2) serving as the magnetic flux generator, proper fixing of a toner image T on a sheet P, and proper prevention of an excessively increased temperature of the fixing roller 20*d*.

Figure 11:
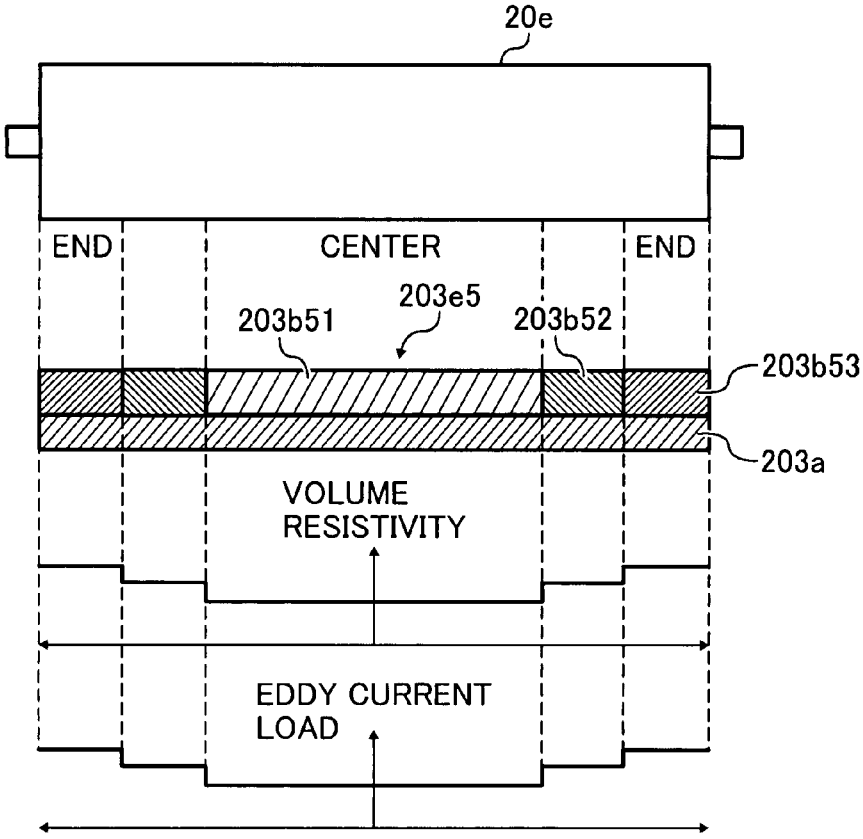
FIG. 11 is a sectional view of a heat generating layer of a fixing roller corresponding to a width direction of the fixing roller according to yet another example embodiment of the present invention.

Referring to FIG. 11, the following describes a fixing roller 20*e* including a heat generating layer 203*e*5 according to yet another example embodiment of the present invention. FIG. 11 illustrates a front view of the fixing roller 20*e* taken along a longitudinal direction (i.e., a width direction) of the fixing roller 20*e*. FIG. 11 further illustrates a sectional view of the heat generating layer 203*e*5 corresponding to the width direction of the fixing roller 20*e*. FIG. 11 further illustrates a graph showing a volume resistivity and an eddy current load of the heat generating layer 203*e*5 corresponding to the width direction of the fixing roller 20*e*.

Like the fixing roller 20 (depicted in FIG. 3), the fixing roller 20*e*, serving as the heat generating member and the fixing member, includes the core 205 serving as the auxiliary layer, the elastic layer 204, the heat generating layer 203*e*5, the silicon rubber layer 202, and/or the releasing layer 201 layered in this order. However, the heat generating layer 203*e*5 has a structure different from the structure of the heat generating layer 203 (depicted in FIG. 5). For example, the heat generating layer 203*e*5 includes the magnetic layer 203*a* and/or low resistance layers 203*b*51, 203*b*52, and 203*b*53. The low resistance layers 203*b*51, 203*b*52, and 203*b*53 have volume resistivities different from each other by varying an amount of filler added to a material of the low resistance layers 203*b*51, 203*b*52, and 203*b*53. The three low resistance layers 203*b*51, 203*b*52, and 203*b*53 have volume resistivities, e.g., not greater than about $5.0\times10^{-8}$ Ω·m, respectively.

Unlike the heat generating layer 203 (depicted in FIG. 5), according to this example embodiment, an eddy current load of the heat generating layer 203*e*5 is set in the range illustrated in the area F in FIG. 6. As illustrated in FIG. 11, a center portion of the heat generating layer 203*e*5 in the width direction of the fixing roller 20*e* (i.e., a width direction of the heat generating layer 203*e*5) has a volume resistivity smaller than a volume resistivity of both end portions of the heat generating layer 203*e*5 in the width direction of the fixing roller 20*e*. Accordingly, the center portion of the heat generating layer 203*e*5 in the width direction of the fixing roller 20*e* has an eddy current load smaller than an eddy current load of the both end portions of the heat generating layer 203*e*5 in the width direction of the fixing roller 20*e*. For example, the magnetic layer 203*a* and the low resistance layers 203*b*51,

203*b*52, and 203*b*53 have volume resistivities different from each other to cause the eddy current load of the center portion of the heat generating layer 203*e*5 in the width direction of the fixing roller 20*e* to be smaller than the eddy current load of the both end portions of the heat generating layer 203*e*5 in the width direction of the fixing roller 20*e*. Namely, the magnetic layer 203*a* has a uniform layer thickness. The low resistance layers 203*b*51, 203*b*52, and 203*b*53 also have a uniform layer thickness and are arranged at reference positions in the width direction of the fixing roller 20*e*, respectively.

The both end portions of the heat generating layer 203*e*5 in the width direction of the fixing roller 20*e* may have a decreased temperature. To address this problem, the both end portions have an increased eddy current load. Thus, the heat generating layer 203*e*5 may have a uniform temperature distribution (i.e., a uniform amount of generated heat) in the width direction of the fixing roller 20*e*, as illustrated in the area F in FIG. 6.

As described above, the fixing roller 20*e* according to this example embodiment illustrated in FIG. 11, like the fixing roller 20 depicted in FIG. 5, includes the heat generating layer 203*e*5 including the magnetic layer 203*a* having a reference Curie point. The eddy current load of the heat generating layer 203*e*5 varies depending on a position in the width direction of the fixing roller 20*e*. Thus, the fixing roller 20*e* may provide an improved heating efficiency with a relatively simple structure, a uniform temperature distribution in the width direction of the fixing roller 20*e* when heated by the induction heater 24 (depicted in FIG. 2) serving as the magnetic flux generator, proper fixing of a toner image T on a sheet P, and proper prevention of an excessively increased temperature of the fixing roller 20*e*.

Figure 12:
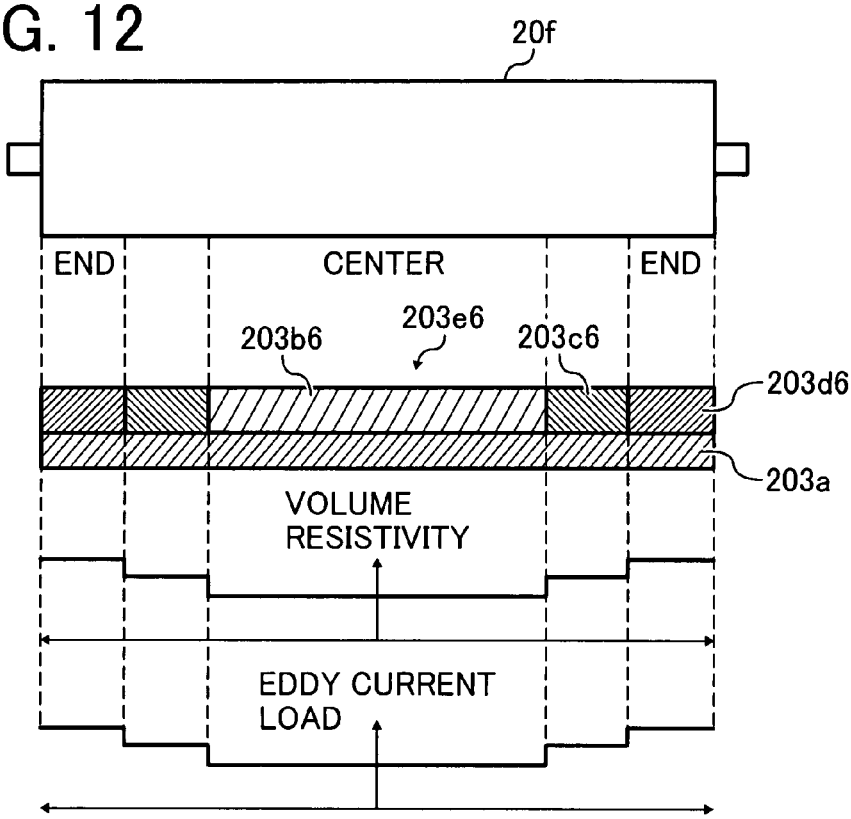
FIG. 12 is a sectional view of a heat generating layer of a fixing roller corresponding to a width direction of the fixing roller according to yet another example embodiment of the present invention.

Referring to FIG. 12, the following describes a fixing roller 20*f* including a heat generating layer 203*e*6 according to yet another example embodiment of the present invention. FIG. 12 illustrates a front view of the fixing roller 20*f* taken along a longitudinal direction (i.e., a width direction) of the fixing roller 20*f*. FIG. 12 further illustrates a sectional view of the heat generating layer 203*e*6 corresponding to the width direction of the fixing roller 20*f*. FIG. 12 further illustrates a graph showing a volume resistivity and an eddy current load of the heat generating layer 203*e*6 corresponding to the width direction of the fixing roller 20*f*.

Like the fixing roller 20 (depicted in FIG. 3), the fixing roller 20*f*, serving as the heat generating member and the fixing member, includes the core 205 serving as the auxiliary layer, the elastic layer 204, the heat generating layer 203*e*6, the silicon rubber layer 202, and/or the releasing layer 201 layered in this order. However, the heat generating layer 203*e*6 has a structure different from the structure of the heat generating layer 203 (depicted in FIG. 5). For example, the heat generating layer 203*e*6 includes the magnetic layer 203*a*, a low resistance layer 203*b*6, a second low resistance layer 203*c*6, and/or a third low resistance layer 203*d*6. The low resistance layer 203*b*6, the second low resistance layer 203*c*6, and the third low resistance layer 203*d*6 have structures common to the low resistance layer 203*b* (depicted in FIG. 5), the second low resistance layer 203*c* (depicted in FIG. 8), and the third low resistance layer 203*d* (depicted in FIG. 8), respectively, except shapes of the low resistance layer 203*b*6, the second low resistance layer 203*c*6, and the third low resistance layer 203*d*6. Like the low resistance layer 203*b*, the second low resistance layer 203*c*6 and the third low resistance layer 203*d*6 have a volume resistivity, e.g., not greater than about $5.0\times10^{-8}$ Ω·m. Namely, the heat generating layer 203*e*6 includes the low resistance layer 203*b*6, the second low resistance layer 203*c*6, and the third low resistance layer 203*d*6 including three different materials, respectively.

Like the heat generating layer 203*e*5 (depicted in FIG. 11), according to this example embodiment, an eddy current load of the heat generating layer 203*e*6 is set in the range illustrated in the area F in FIG. 6. As illustrated in FIG. 12, a center portion of the heat generating layer 203*e*6 in the width direction of the fixing roller 20*f* (i.e., a width direction of the heat generating layer 203*e*6) has a volume resistivity smaller than a volume resistivity of both end portions of the heat generating layer 203*e*6 in the width direction of the fixing roller 20*f*. Accordingly, the center portion of the heat generating layer 203*e*6 in the width direction of the fixing roller 20*f* has an eddy current load smaller than an eddy current load of the both end portions of the heat generating layer 203*e*6 in the width direction of the fixing roller 20*f*. For example, the magnetic layer 203*a*, the low resistance layer 203*b*6, the second low resistance layer 203*c*6, and the third low resistance layer 203*d*6 cause the eddy current load of the center portion of the heat generating layer 203*e*6 in the width direction of the fixing roller 20*f* to be smaller than the eddy current load of the both end portions of the heat generating layer 203*e*6 in the width direction of the fixing roller 20*f*. Namely, the magnetic layer 203*a* has a uniform layer thickness. The low resistance layer 203*b*6, the second low resistance layer 203*c*6, and the third low resistance layer 203*d*6 also have a uniform layer thickness and are arranged at reference positions in the width direction of the fixing roller 20*f*, respectively.

The both end portions of the heat generating layer 203*e*6 in the width direction of the fixing roller 20*f* may have a decreased temperature. To address this problem, the both end portions have an increased eddy current load. Thus, the heat generating layer 203*e*6 may have a uniform temperature distribution (i.e., a uniform amount of generated heat) in the width direction of the fixing roller 20*f*, as illustrated in the area F in FIG. 6.

As described above, the fixing roller 20*f* according to this example embodiment illustrated in FIG. 12, like the fixing roller 20 depicted in FIG. 5, includes the heat generating layer 203*e*6 including the magnetic layer 203*a* having a reference Curie point. The eddy current load of the heat generating layer 203*e*6 varies depending on a position in the width direction of the fixing roller 20*f*. Thus, the fixing roller 20*f* may provide an improved heating efficiency with a relatively simple structure, a uniform temperature distribution in the width direction of the fixing roller 20*f* when heated by the induction heater 24 (depicted in FIG. 2) serving as the magnetic flux generator, proper fixing of a toner image T on a sheet P, and proper prevention of an excessively increased temperature of the fixing roller 20*f*.

Figure 13:
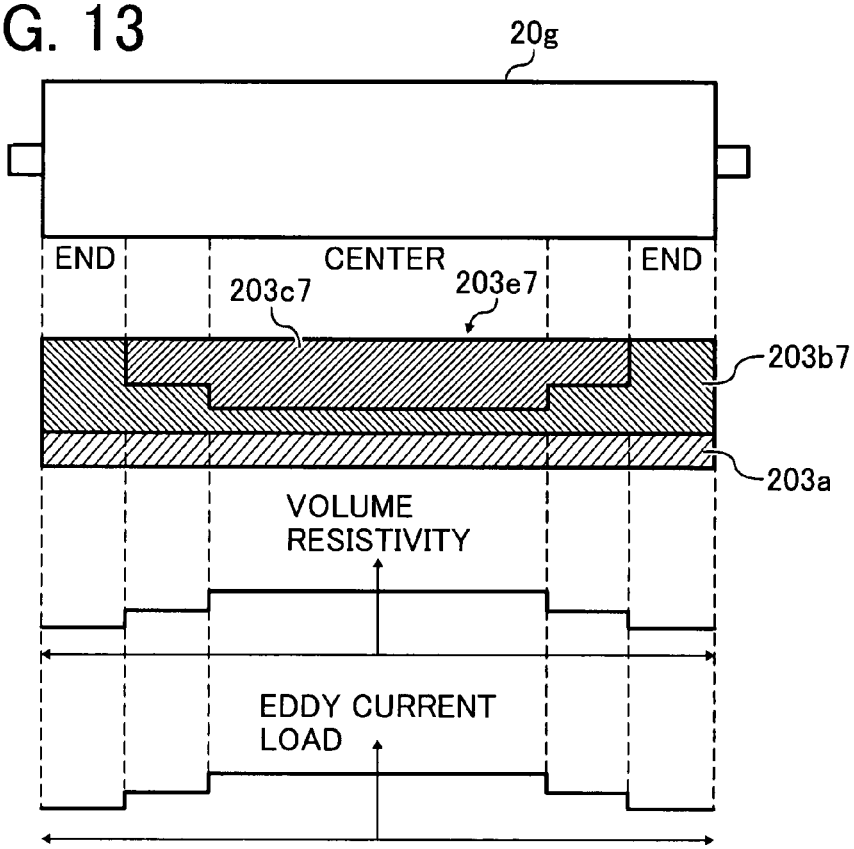
FIG. 13 is a sectional view of a heat generating layer of a fixing roller corresponding to a width direction of the fixing roller according to yet another example embodiment of the present invention.

Referring to FIG. 13, the following describes a fixing roller 20*g* including a heat generating layer 203*e*7 according to yet another example embodiment of the present invention. FIG. 13 illustrates a front view of the fixing roller 20*g* taken along a longitudinal direction (i.e., a width direction) of the fixing roller 20*g*. FIG. 13 further illustrates a sectional view of the heat generating layer 203*e*7 corresponding to the width direction of the fixing roller 20*g*. FIG. 13 further illustrates a graph showing a volume resistivity of the heat generating layer 203*e*7 corresponding to the width direction of the fixing roller 20*g*. FIG. 13 further illustrates a graph showing an eddy current load of the heat generating layer 203*e*7 corresponding to the width direction of the fixing roller 20*g*.

Like the fixing roller 20 (depicted in FIG. 3), the fixing roller 20*g*, serving as the heat generating member and the fixing member, includes the core 205 serving as the auxiliary layer, the elastic layer 204, the heat generating layer 203*e*7, the silicon rubber layer 202, and/or the releasing layer 201 layered in this order. However, the heat generating layer 203*e*7 has a structure different from the structure of the heat generating layer 203 (depicted in FIG. 5). For example, the heat generating layer 203*e*7 includes the magnetic layer 203*a*, a low resistance layer 203*b*7, and/or a second low resistance layer 203*c*7. The low resistance layer 203*b*7 and the second low resistance layer 203*c*7 have structures common to the low resistance layer 203*b* (depicted in FIG. 5) and the second low resistance layer 203*c* (depicted in FIG. 8), respectively, except shapes of the low resistance layer 203*b*7 and the second low resistance layer 203*c*7. The low resistance layer 203*b*7 and the second low resistance layer 203*c*7 have a volume resistivity, e.g., not greater than about $5.0\times10^{-8}$ Ω·m. Namely, the heat generating layer 203*e*7 includes the low resistance layer 203*b*7 and the second low resistance layer 203*c*7 including two different materials, respectively.

Like the heat generating layer 203 (depicted in FIG. 5), according to this example embodiment, an eddy current load of the heat generating layer 203*e*7 is set in the range illustrated in the area G in FIG. 6. As illustrated in FIG. 13, a center portion of the heat generating layer 203*e*7 in the width direction of the fixing roller 20*g* (i.e., a width direction of the heat generating layer 203*e*7) has a volume resistivity greater than a volume resistivity of both end portions of the heat generating layer 203*e*7 in the width direction of the fixing roller 20*g*. As illustrated in FIG. 13, the center portion of the heat generating layer 203*e*7 in the width direction of the fixing roller 20*g* has an eddy current load greater than an eddy current load of the both end portions of the heat generating layer 203*e*7 in the width direction of the fixing roller 20*g*. For example, the magnetic layer 203*a*, the low resistance layer 203*b*7, and the second low resistance layer 203*c*7 cause the center portion of the heat generating layer 203*e*7 in the width direction of the fixing roller 20*g* to have the eddy current load greater than the eddy current load of the both end portions of the heat generating layer 203*e*7 in the width direction of the fixing roller 20*g*. The magnetic layer 203*a* has a uniform layer thickness. The layer thickness of each of the low resistance layer 203*b*7 and the second low resistance layer 203*c*7 varies depending on a position in the width direction of the fixing roller 20*g*.

The both end portions of the heat generating layer 203*e*7 in the width direction of the fixing roller 20*g* may have a decreased temperature. To address this problem, the both end portions have a decreased eddy current load. Thus, the heat generating layer 203*e*7 may have a uniform temperature distribution (i.e., a uniform amount of generated heat) in the width direction of the fixing roller 20*g*, as illustrated in the area G in FIG. 6.

As described above, the fixing roller 20*g* according to this example embodiment illustrated in FIG. 13, like the fixing roller 20 depicted in FIG. 5, includes the heat generating layer 203*e*7 including the magnetic layer 203*a* having a reference Curie point. The eddy current load of the heat generating layer 203*e*7 varies depending on a position in the width direction of the fixing roller 20*g*. Thus, the fixing roller 20*g* may provide an improved heating efficiency with a relatively simple structure, a uniform temperature distribution in the width direction of the fixing roller 20*g* when heated by the induction heater 24 (depicted in FIG. 2) serving as the magnetic flux generator, proper fixing of a toner image T on a sheet P, and proper prevention of an excessively increased temperature of the fixing roller 20*g*.

Figure 14:
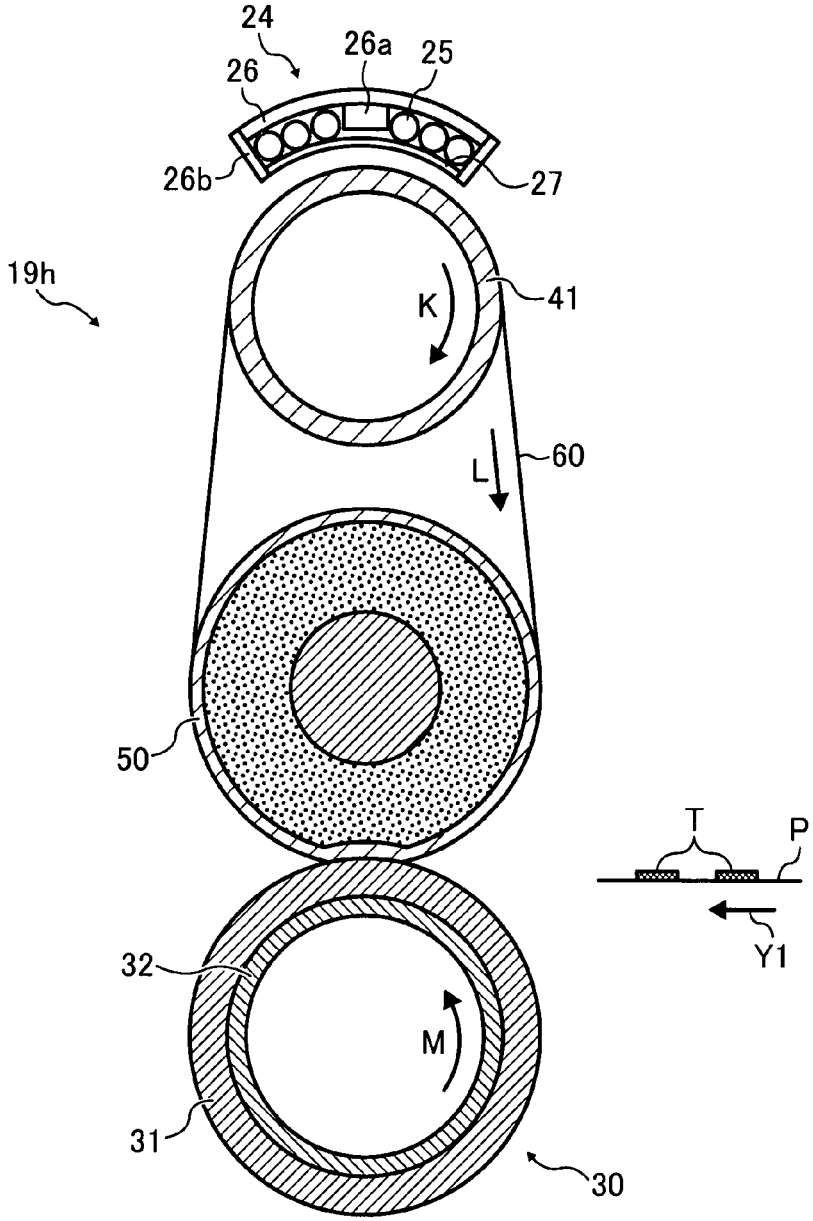
FIG. 14 is a sectional view of a fixing device according to yet another example embodiment of the present invention.
Figure 15:
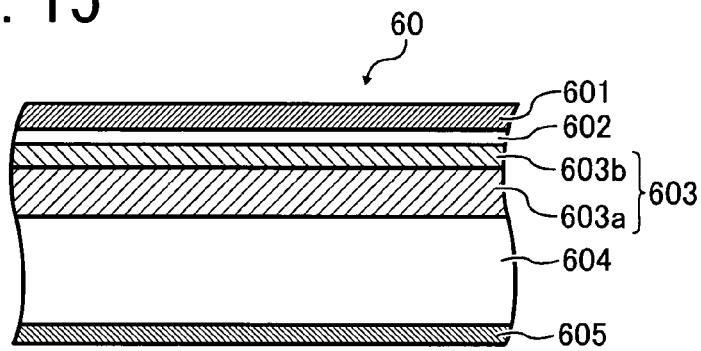
FIG. 15 is an enlarged sectional view (according to an example embodiment of the present invention) of a part of a fixing belt of the fixing device shown in FIG. 14.

Referring to FIGS. 14 and 15, the following describes a fixing device 19*h* according to another example embodiment of the present invention. FIG. 14 is a sectional view of the fixing device 19*h*. As illustrated in FIG. 14, the fixing device 19*h* includes the induction heater 24 and/or the pressing roller 30 which are common to the fixing device 19 depicted in FIG. 2, but further includes an auxiliary fixing roller 50, a support roller 41, and/or a fixing belt 60. Namely, the fixing device 19*h* includes the fixing belt 60 instead of the fixing roller 20 (depicted in FIG. 2) serving as a fixing member for melting a toner image T on a sheet P by applying heat to the sheet P.

The fixing device 19*h* fixes a toner image T on a sheet P conveyed in the direction Y1. The auxiliary fixing roller 50 includes a core (not shown) and/or an elastic layer (not shown). The core includes stainless steel. The elastic layer includes a silicon rubber and is formed on the core. The elastic layer has a layer thickness, e.g., from about 1 mm to about 5 mm and an Asker hardness, e.g., from about 30 degrees to about 60 degrees. The support roller 41 may include stainless steel and rotates in a rotating direction K.

The fixing belt 60 is looped over the auxiliary fixing roller 50 and the support roller 41. Namely, the auxiliary fixing roller 50 and the support roller 41 serve as rollers for supporting the fixing belt 60. The fixing belt 60 serves as a heat generating member for generating heat by induction heating performed by the induction heater 24. The fixing belt 60 also serves as a fixing member for melting a toner image T on a sheet P by applying heat to the sheet P.

FIG. 15 is a sectional view of a part of the fixing belt 60. As illustrated in FIG. 15, the fixing belt 60 includes an auxiliary layer 605, an elastic layer 604, a heat generating layer 603, a silicon rubber layer 602, and/or a releasing layer 601. The heat generating layer 603 includes a magnetic layer 603*a* and/or a low resistance layer 603*b*. The auxiliary layer 605, the elastic layer 604, the heat generating layer 603, the silicon rubber layer 602, and the releasing layer 601 are layered in this order from an inner circumferential side to an outer circumferential side of the fixing belt 60, and have structures similar to the structures of the core 205, the elastic layer 204, the heat generating layer 203, the silicon rubber layer 202, and the releasing layer 201 depicted in FIG. 3, respectively. The heat generating layer 603 has an eddy current load varying depending on a position in a width direction of the fixing belt 60 (i.e., a width direction of the heat generating layer 603).

The fixing belt 60 rotates in a rotating direction L (depicted in FIG. 14). When the temperature of the magnetic layer 603*a* does not reach a Curie point, the induction heater 24 (depicted in FIG. 14) heats the heat generating layer 603 by generating a magnetic flux.

Referring to FIGS. 14 and 15, the following describes operations of the fixing device 19*h*. The auxiliary fixing roller 50 is driven to rotate the fixing belt 60 in the rotating direction L. The rotating fixing belt 60 rotates the support roller 41 in the rotating direction K. Accordingly, the pressing roller 30 rotates in a rotating direction M. The induction heater 24 opposes the fixing belt 60 at an opposing position at which the induction heater 24 heats the fixing belt 60.

For example, a power source (not shown) applies a high-frequency alternating current in a range, e.g., from about 10 kHz to about 1 MHz (more particularly, e.g., in a range from about 20 kHz to about 800 kHz) to the coil 25. Magnetic lines of force are formed toward the heat generating layer 603. Directions of the magnetic lines of force alternately switch in opposite directions to form an alternating magnetic field. An eddy current generates in the heat generating layer 603. An electric resistance of the heat generating layer 603 generates Joule heat. Thus, the fixing belt 60 is heated by the Joule heat generated by the heat generating layer 603.

A portion on an outer circumferential surface of the fixing belt 60 heated by the induction heater 24 moves to a contact position (e.g., a fixing nip) at which the fixing belt 60 contacts the pressing roller 30. At the contact position, the fixing belt 60 applies heat to a sheet P conveyed in the direction Y1 to fix a toner image T on the sheet P.

The portion on the outer circumferential surface of the fixing belt 60 heated by the induction heater 24 reaches the opposing position at which the induction heater 24 opposes the fixing belt 60 again after moving out of the fixing nip. The above-described operations of the fixing device 19 are repeated to complete a fixing process in an image forming process.

As described above, the fixing belt 60 according to this example embodiment includes the heat generating layer 603 including the magnetic layer 603*a* having a reference Curie point. An eddy current load of the heat generating layer 603 varies depending on a position in the width direction of the fixing belt 60. Thus, the fixing belt 60 may provide an improved heating efficiency with a relatively simple structure, a uniform temperature distribution in the width direction of the fixing belt 60 when heated by the induction heater 24 serving as a magnetic flux generator for generating a magnetic flux, proper fixing of a toner image T on a sheet P, and proper prevention of an excessively increased temperature of the fixing belt 60.

According to this example embodiment, the fixing belt 60 is used as the heat generating member. However, both the support roller 41 and the fixing belt 60 may be used as the heat generating members. In this case, the support roller 41 and the fixing belt 60 may provide the effects provided by the fixing belt 60 according to this example embodiment.

According to this example embodiment, the fixing belt 60 includes the auxiliary layer 605 including aluminum. However, the support roller 41 may include aluminum to serve as an auxiliary layer. In this case, the fixing belt 60 may not include the auxiliary layer 605. Thus, the support roller 41 and/or the fixing belt 60 may provide the effects provided by the fixing belt 60 according to this example embodiment.

The present invention has been described above with reference to specific example embodiments. Nonetheless, the present invention is not limited to the details of example embodiments described above, but various modifications and improvements are possible without departing from the spirit and scope of the present invention. It is therefore to be understood that within the scope of the associated claims, the present invention may be practiced otherwise than as specifically described herein. For example, elements and/or features of different illustrative example embodiments may be combined with each other and/or substituted for each other within the scope of the present invention.

What is claimed is:

1. An image forming apparatus, comprising:

a fixing device to fix a toner image onto a recording medium, the fixing device including a magnetic flux generator to generate a magnetic flux, and a heat generating member facing the magnetic flux generator, the heat generating member including a heat generating layer to generate heat by the magnetic flux generated by the magnetic flux generator and to have an eddy current load, obtained by dividing a volume resistivity by a layer thickness, varying depending on a position in a width direction of the heat generating layer, wherein the heat generating layer includes a center portion and an end portion in the width direction of the heat generating layer, and wherein an eddy current load of the center portion is smaller than an eddy current load of the end portion when the eddy current load of the center portion is not greater than a reference value.

2. An image forming apparatus, comprising:

a fixing device to fix a toner image onto a recording medium, the fixing device including a magnetic flux generator to generate a magnetic flux, and a heat generating member facing the magnetic flux generator, the heat generating member including a heat generating layer to generate heat by the magnetic flux generated by the magnetic flux generator and to have an eddy current load, obtained by dividing a volume resistivity by a layer thickness, varying depending on a position in a width direction of the heat generating layer, wherein the heat generating layer includes a center portion and an end portion in the width direction of the heat generating layer, and wherein an eddy current load of the center portion is greater than an eddy current load of the end portion when the eddy current load of the center portion is not smaller than a reference value.

3. An image forming apparatus, comprising:

an image carrier to carry a toner image to be transferred onto a recording medium; and a fixing device to fix the toner image transferred from the image carrier on the recording medium by applying heat to the recording medium, the fixing device including a magnetic flux generator to generate a magnetic flux, and a heat generating member opposing the magnetic flux generator, the heat generating member including a heat generating layer to generate heat by the magnetic flux generated by the magnetic flux generator and to have an eddy current load, obtained by dividing a volume resistivity by a layer thickness, varying depending on a position in a width direction of the heat generating layer, the heat generating layer including a magnetic layer having a Curie point in a range of from about 100 degrees centigrade to about 300 degrees centigrade, wherein the heat generating layer has a layer thickness being uniform in the width direction of the heat generating layer and a volume resistivity varying depending on a position in the width direction of the heat generating layer.

4. The image forming apparatus according to claim 1, wherein the heat generating layer includes a magnetic layer having a Curie point in a range of from about 100 degrees centigrade to about 300 degrees centigrade.

5. The image forming apparatus according to claim 1, wherein the heat generating layer includes a magnetic layer having a Curie point in a range of from about 100 degrees centigrade to about 300 degrees centigrade.

6. The image forming apparatus according to claim 4, wherein the heat generating layer further includes a low resistant layer having a volume resistivity not greater than about $1.0\times10^{-7}$ Ω·m, and wherein the low resistant layer is provided between the magnetic flux generator and the magnetic layer.

7. The image forming apparatus according to claim 5, wherein the heat generating layer further includes a low resistant layer having a volume resistivity not greater than about $1.0\times10^{-7}$ Ω·m, and wherein the low resistant layer is provided between the magnetic flux generator and the magnetic layer.

8. The image forming apparatus according to claim 4, wherein the heat generating member further includes an auxiliary layer provided opposite the magnetic flux generator with respect to the heat generating layer, and wherein a volume resistivity of the auxiliary layer is lower than a volume resistivity of the magnetic layer.

9. The image forming apparatus according to claim 5, wherein the heat generating member further includes an auxiliary layer provided opposite the magnetic flux generator with respect to the heat generating layer, and wherein a volume resistivity of the auxiliary layer is lower than a volume resistivity of the magnetic layer.

10. The image forming apparatus according to claim 3, wherein the heat generating layer includes a magnetic layer having a Curie point in a range of from about 100 degrees centigrade to about 300 degrees centigrade, wherein the heat generating member further includes an auxiliary layer provided opposite the magnetic flux generator with respect to the heat generating layer, and wherein a volume resistivity of the auxiliary layer is lower than a volume resistivity of the magnetic layer.

11. The image forming apparatus according to claim 8, wherein when the magnetic layer has a temperature not smaller than the Curie point, the magnetic flux generated by the magnetic flux generator penetrates the magnetic layer and reaches the auxiliary layer.

12. The image forming apparatus according to claim 9, wherein when the magnetic layer has a temperature not smaller than the Curie point, the magnetic flux generated by the magnetic flux generator penetrates the magnetic layer and reaches the auxiliary layer.

13. The image forming apparatus according to claim 8, wherein the heat generating member further includes an elastic layer provided between the magnetic layer and the auxiliary layer.

14. The image forming apparatus according to claim 9, wherein the heat generating member further includes an elastic layer provided between the magnetic layer and the auxiliary layer.

15. The image forming apparatus according to claim 8, wherein the auxiliary layer includes aluminum.

16. The image forming apparatus according to claim 9, wherein the auxiliary layer includes aluminum.

17. The image forming apparatus according to claim 8, wherein the heat generating member includes a fixing roller, the magnetic flux generator is provided outside the fixing roller, and the auxiliary layer includes a core of the fixing roller.

18. The image forming apparatus according to claim 9, wherein the heat generating member includes a fixing roller, the magnetic flux generator is provided outside the fixing roller, and the auxiliary layer includes a core of the fixing roller.

19. The image forming apparatus according to claim 8, wherein the heat generating member includes a fixing belt, the magnetic flux generator is provided outside a loop of the fixing belt, and the auxiliary layer includes an inner circumferential surface of the fixing belt.

20. The image forming apparatus according to claim 9, wherein the heat generating member includes a fixing belt, the magnetic flux generator is provided outside a loop of the fixing belt, and the auxiliary layer includes an inner circumferential surface of the fixing belt.

* * * * *